US007530670B2

(12) United States Patent
Matsushita et al.

(10) Patent No.: US 7,530,670 B2
(45) Date of Patent: May 12, 2009

(54) ELECTROSTATIC ACTUATOR, DROPLET DISCHARGING HEAD, DROPLET DISCHARGING APPARATUS, ELECTROSTATIC DEVICE, AND METHOD OF MANUFACTURING THESE

(75) Inventors: Tomonori Matsushita, Fujimi (JP); Yasushi Matsuno, Matsumoto (JP); Masahiro Fujii, Shiojiri (JP)

(73) Assignee: Seiko Epson Corporation (JP)

( * ) Notice: Subject to any disclaimer, the term of this patent is extended or adjusted under 35 U.S.C. 154(b) by 478 days.

(21) Appl. No.: 11/314,642

(22) Filed: Dec. 21, 2005

(65) Prior Publication Data

US 2006/0139409 A1 Jun. 29, 2006

(30) Foreign Application Priority Data

| | | |
|---|---|---|
| Dec. 27, 2004 | (JP) | 2004-375687 |
| Jul. 8, 2005 | (JP) | 2005-200109 |
| Oct. 18, 2005 | (JP) | 2005-303453 |

(51) Int. Cl.
*B41J 2/04* (2006.01)

(52) U.S. Cl. ..... 347/54; 347/55

(58) Field of Classification Search ..... 347/20, 347/55, 68, 70–72

See application file for complete search history.

(56) References Cited

U.S. PATENT DOCUMENTS 6,517,195 B1 * 2/2003 Koeda ..... 347/68

FOREIGN PATENT DOCUMENTS

| | | | |
|---|---|---|---|
| JP | 2001-179974 | | 7/2001 |
| JP | 2001-232794 | | 8/2001 |
| JP | 2002-001972 | | 1/2002 |
| JP | 2002-052710 | * | 2/2002 |
| JP | 2002-172790 | | 6/2002 |
| JP | 2002-272145 | | 9/2002 |
| JP | 2004-074735 | | 3/2004 |

* cited by examiner

*Primary Examiner*—Juanita D Stephens
(74) *Attorney, Agent, or Firm*—Harness, Dickey & Pierce, P.L.C.

(57) ABSTRACT

To provide an electrostatic actuator, etc. which is capable of miniaturizing the size, and preventing moisture, etc. from entering a gap in an effective manner. An electrostatic actuator includes an electrode substrate 10 having individual electrodes 12 as fixed electrodes, and a cavity substrate 20 having diaphragms 22 as movable electrodes which are disposed so as to be opposed to the fixed electrodes 12 with a predetermined distance, and operated due to an electrostatic force occurring between the cavity substrate 20 and the individual electrodes 12. Sealing portions 26*a* are formed on one of the electrode substrate 10 and the cavity substrate 20, each of the sealing portions 26*a* has a plurality of sealing layers (a TEOS layer 25*a*, a moisture permeation preventing layer 25*b*) laminated one another, and each of the sealing layers is made of a sealing material 25 for isolating a space formed between the individual electrode 12 and the diaphragm 22.

17 Claims, 13 Drawing Sheets

FIG. 2
FIG. 2 (a)
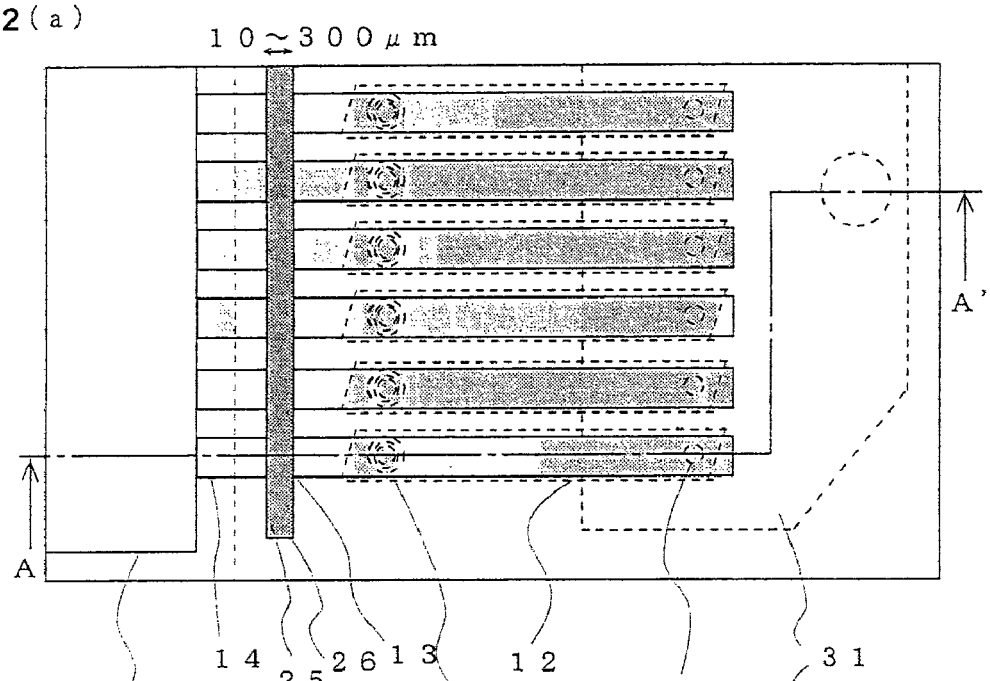
FIG. 2 (b)
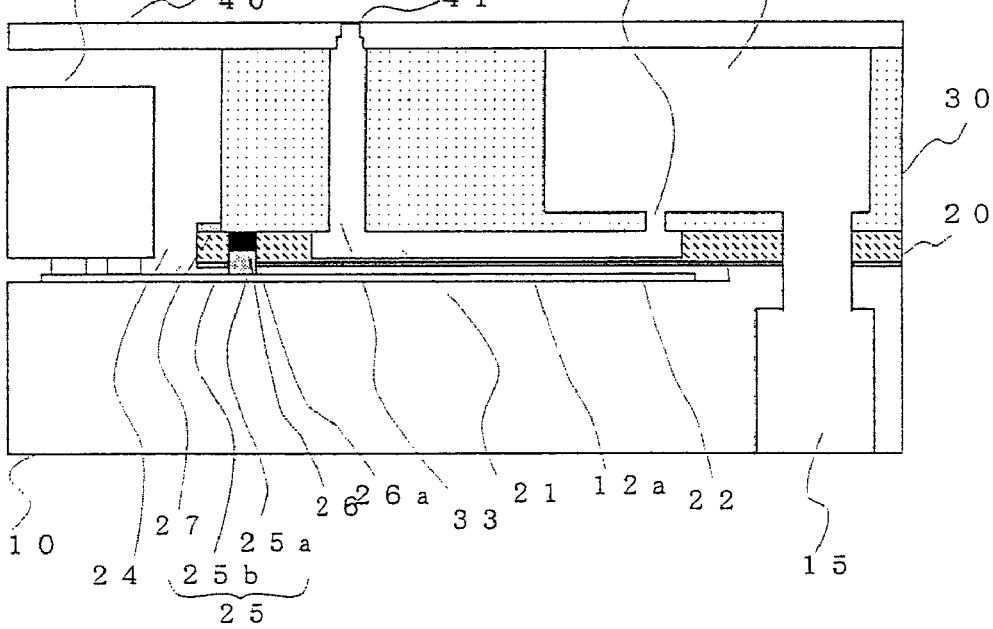

FIG. 5
FIG. 5(g)
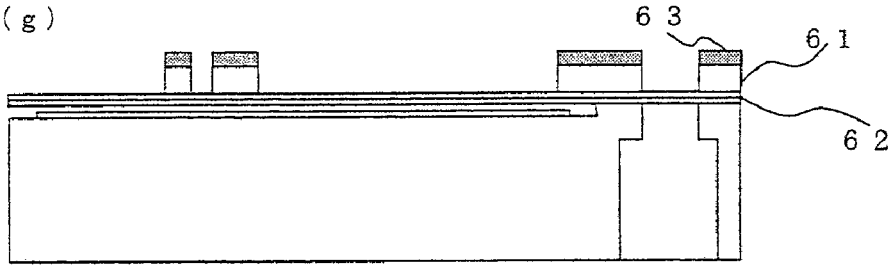
FIG. 5(h)
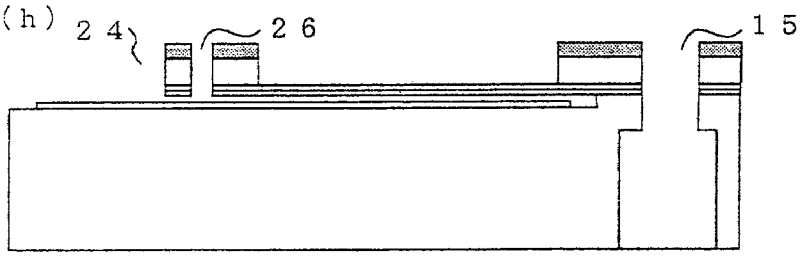
FIG. 5(i)
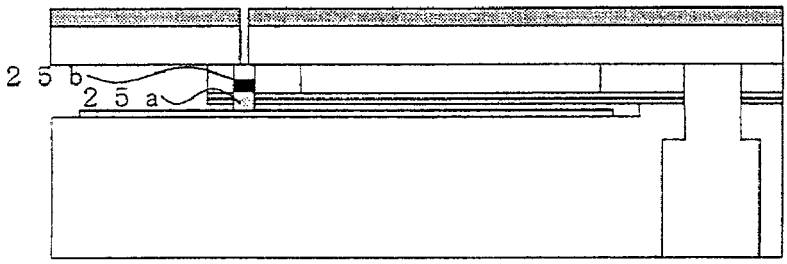
FIG. 5(j)
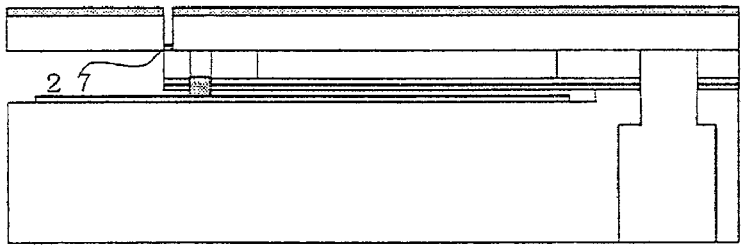
FIG. 5(k)
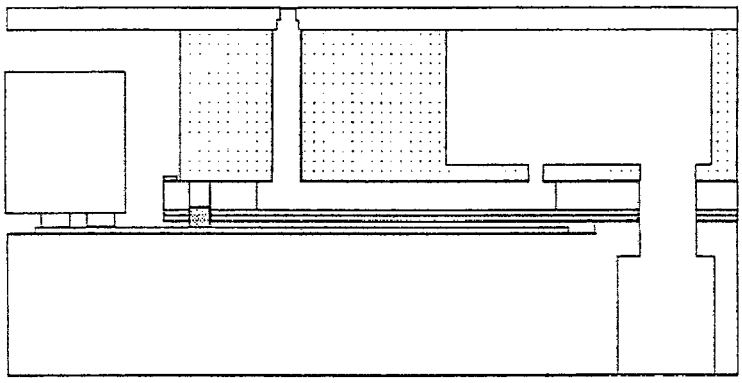

FIG. 7
FIG. 7(a)
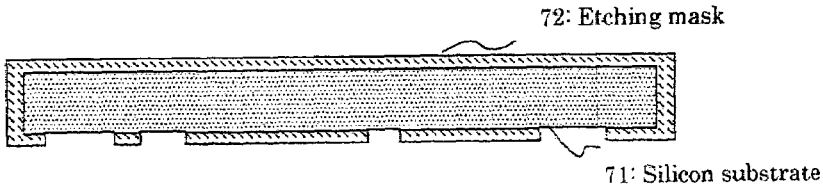
FIG. 7(b)
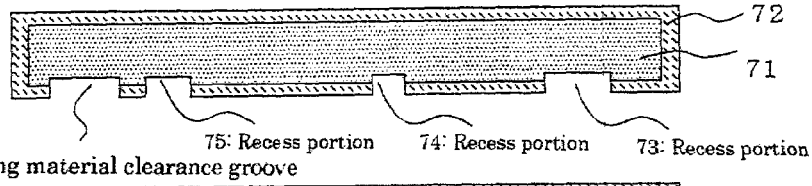
FIG. 7(c)
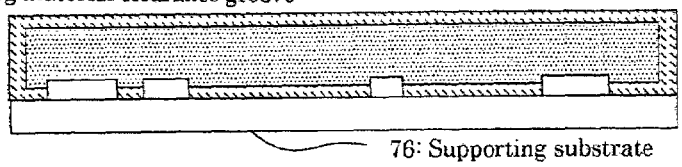
FIG. 7(d)
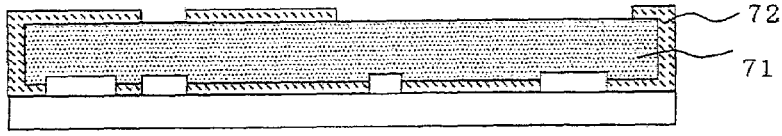
FIG. 7(e)
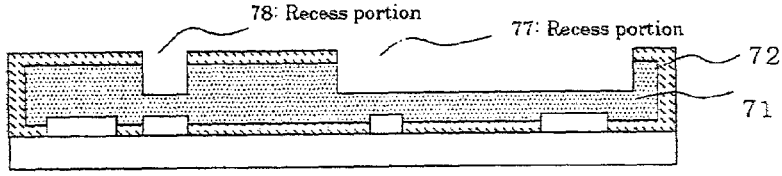
FIG. 7(f)
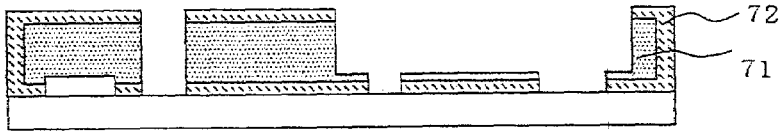
FIG. 7(g)
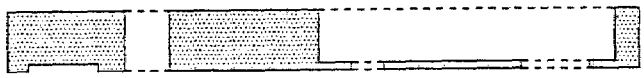

FIG. 10
FIG. 10(a)
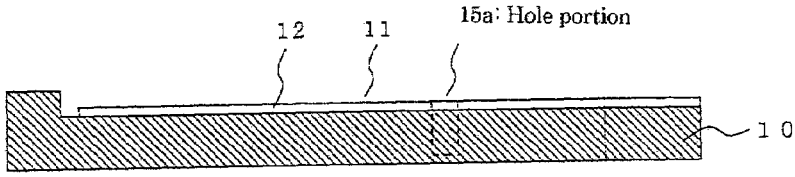
FIG. 10(b)
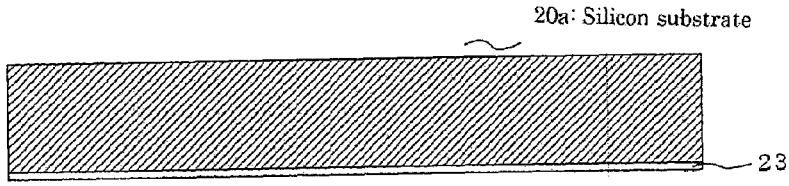
FIG. 10(c)
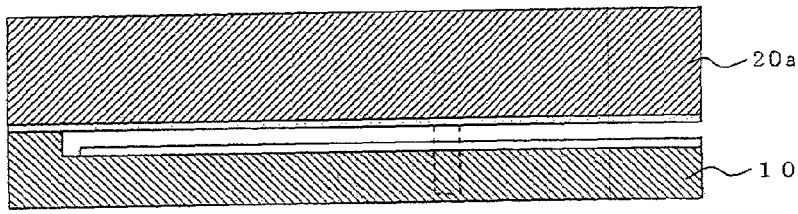
FIG. 10(d)
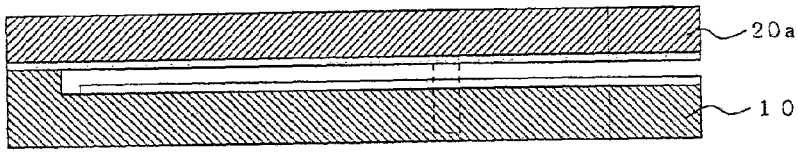

FIG. 11
FIG. 11(e)
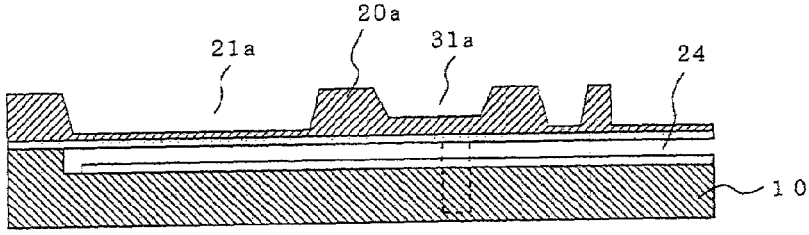
FIG. 11(f)
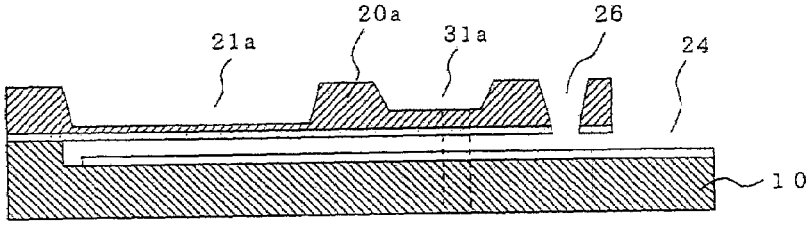
FIG. 11(g)
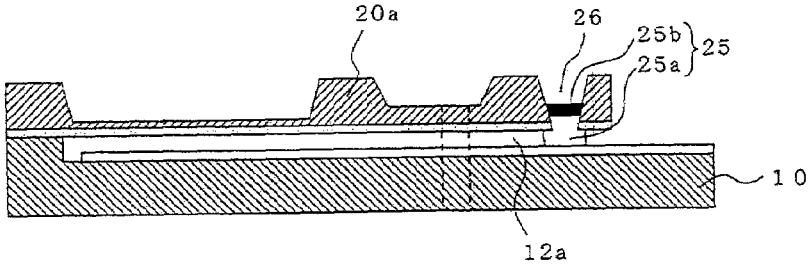
FIG. 11(h)
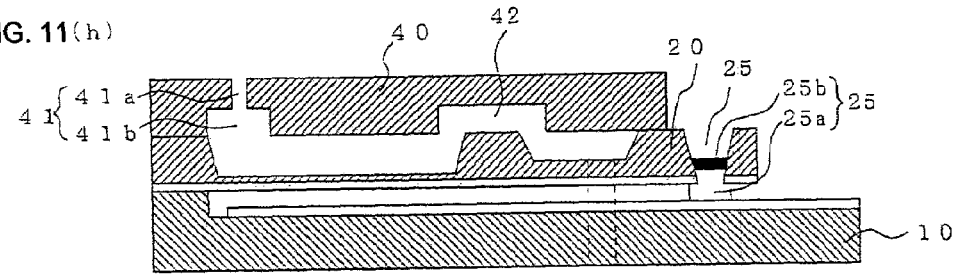

ELECTROSTATIC ACTUATOR, DROPLET DISCHARGING HEAD, DROPLET DISCHARGING APPARATUS, ELECTROSTATIC DEVICE, AND METHOD OF MANUFACTURING THESE

The entire disclosure of Japanese Patent Application No. 2004-375687, filed Dec. 27, 2004, Japanese Patent Application No. 2005-200109, filed Jul. 8, 2005, Japanese Patent Application No. 2005-303453, filed Oct. 18, 2005, are expressly incorporated by reference herein.

TECHNICAL FIELD

The present invention relates to an electrostatic device, such as an electrostatic actuator, a droplet discharging head, etc. as a micromachined element in which a movable portion is displaced due to an applied force, etc., and hence is operated, etc., an apparatus using the device, and a method of manufacturing the same. More particularly, the present invention relates to sealing which is carried out in the micromachined element.

BACKGROUND ART

Recently, micro electro mechanical systems (MEMS), such as machining silicon, etc. to form a micro element, etc have made enormous progress. Examples of the micromachined element formed by micro electro mechanical systems (MEMS) include an electrostatic actuator, such as a droplet discharging head (an ink jet head) used in a recording (printing) apparatus such as a droplet discharge type printer, a micro pump, an optical variable filter, and a motor, and a pressure sensor, etc.

On this occasion, a description will be given of the droplet discharging head as an electrostatic actuator, as an example of the micromachined element. Droplet discharge type recording (printing) apparatuses are used for printing in a whole range of fields including household use and industrial use. The droplet discharge type means, for example, moving a droplet discharging head having a plurality of nozzles relative to a target object (sheet, etc.), and then discharging droplets to the target object at a predetermined location to carry out printing, etc. This type is used in manufacturing color filters for producing display devices using liquid crystal, display panels using electroluminescence elements such as organic compounds (OLED), microarrays of biological molecule, such as DNAs, and protein substances, etc.

There exists a droplet discharging head of one type comprising a discharging chamber for storing liquid in part of a flow passage. According to this droplet discharging head, an inside of the discharging chamber is pressurized by deformation of at least one side wall (a bottom wall in this case, hereinafter referred to as diaphragm) of the discharging chamber caused by its deflection (operation) to permit the droplets to be discharged through nozzles communicated with the chamber. A force to displace the diaphragm as a movable electrode includes; for example, an electrostatic force (frequently an electrostatic attracting force) occurring between the diaphragm and an electrode (fixed electrode) opposed to the diaphragm with a distance.

In the above-mentioned electrostatic actuator utilizing an electrostatic force, charging the diaphragm and an individual electrode (opposed electrode) causes the diaphragm to be attracted and deflected toward the individual electrode. The diaphragm and the individual electrode maintain a predetermined gap (air gap, space) therebetween, so as to be arranged opposed to each other across this gap.

Generally, in electrostatic drive type ink jet recoding apparatuses, the gap between the diaphragm and the individual electrode is sealed by a sealing material. This aims to, for example, prevent an electrostatic attracting force and an electrostatic repulsive force from lowering by moisture adhered to a bottom surface of the diaphragm and a surface of the individual electrode. Further, this sealing material has also a function of preventing foreign substances, etc. from entering the gap.

In commonly used conventional electrostatic drive type ink jet heads, the gap is sealed by pouring an epoxy resin material, etc. into the gap between the diaphragm and the individual electrode.

In conventional ink jet heads and methods of manufacturing the same, an opening (communicating hole) of the gap between the diaphragm and the individual electrode is sealed by forming an oxide film thereon by a CVD (chemical vapor deposition) method, etc. (for example, refer to Patent Document 1)

Moreover, in conventional electrostatic actuators and ink jet heads using the same, the gap between the diaphragm and the individual electrode is sealed by using a silicon-containing polyimide family sealing material (for example, refer to Patent Document 2).

[Patent Document 1]

Japanese Patent Application Laid-Open No. 2002-1972 (page 1, FIG. 1)

[Patent Document 2]

Japanese Patent Application Laid-Open No. 2002-172790 (page 1, FIG. 1)

SUMMARY

In the electrostatic actuators, typically the conventional electrostatic drive type ink jet heads, the gap is generally sealed by an epoxy resin material, etc.; however, when the sealing material is made of an epoxy resin material, the epoxy resin material unfavorably enters deep into the gap due to capillary action, thereby it is necessary to enlarge a margin to be sealed so as to prevent the sealing material from penetrating into the electrostatic actuator, which provides a problem of making it difficult to miniaturize the ink jet head. Further, it is generally impossible to control the capillary action, which poses a problem that sealing conditions are different between gaps.

Also, in the conventional ink jet heads and the methods of manufacturing the same (for example, refer to Patent Document 1), the sealing is carried out by only one kind of the oxide film; however, when the oxide film is made of an oxide silicon film, for example, the sealing material needs to be increased in thickness because the silicon oxide film is high in moisture permeation, which provides a problem of making it difficult to miniaturize the ink jet head.

Further, when the oxide film is made of an aluminum oxide film, the sealing material can be decreased in thickness because oxide aluminum is low in moisture permeation, which provides, however, a problem of difficult manufacturing of the ink jet head, etc. due to a long time necessary for film-formation, easy reaction to an alkaline solution.

Besides, in the conventional electrostatic actuators and the ink jet heads using the same (for example, refer to Patent Document 2), the sealing material is made of a silicon-containing polyimide family sealing material. However, since it is in liquid form, the silicon-containing polyimide family sealing material unfavorably enters deep into the gap due to capillarity action, as is the case with the epoxy resin material, which provides a problem of making difficult it to miniaturize the ink jet head. Further, in the manufacturing process, when the silicon-containing polyimide family sealing material is unfavorably adhered to a portion which originally does not require sealing, such as a portion connected to another substrate, or a portion as a terminal of a taken out electrode, the material prevents contact with the another substrate or electrical connection with electric power supplying means, which necessitates a removing process.

It is, therefore, an object of the present invention to provide an electrostatic actuator, an droplet discharging head, an droplet discharging apparatus, and an electrostatic device, as well as a method of manufacturing these, which are capable of miniaturizing the size, effectively preventing moisture, etc. from entering a gap in an effective manner, adhering a sealing material to only a desired portion, etc. to carry out sealing in a reliable and effective manner, and eliminating the need for removing a excessively adhered sealing material.

An electrostatic actuator according to the invention comprises: a first substrate having a fixed electrode; and a second substrate having a movable electrode which is disposed so as to be opposed to the fixed electrode with a distance, and operated due to an electrostatic force occurring between the fixed electrode and the movable electrode, characterized in that a sealing portion is formed on one of the first substrate and the second substrate, the sealing portion having a plurality of sealing layers laminated one another, each of the sealing layers being made of a sealing material for isolating a space formed between the fixed electrode and the movable electrode from surrounding atmosphere.

According to the invention, the sealing portion for sealing the space formed between the fixed electrode and the movable electrode has at least two layers of the sealing layers which are different in material from each other. Therefore, constructing one layer by a low moisture permeation substance and another layer by a superior chemical resistance substance, for example, prevents moisture from entering the space, and provides the sealing superior in the chemical resistance. Also, since the low moisture permeation layer is formed, it is possible to decrease the thickness of the sealing portion compared with a single layer, and further to miniaturize the electrostatic actuator.

Moreover, forming the sealing layer of TEOS (tetraethyl orthosilicate) by a plasma CVD method prevents the sealing material from entering deep into the gap, thereby reducing a margin to be sealed, which results in two-dimensional miniaturization of the electrostatic actuator.

Further, an electrostatic actuator according to the invention comprises: a first substrate having a fixed electrode; and a second substrate having a movable electrode which is disposed so as to be opposed to the fixed electrode with a distance, and operated due to an electrostatic force occurring between the fixed electrode and the movable electrode, characterized in that a through-slot, through which a sealing material for isolating a space formed between the fixed electrode and the movable electrode from surrounding atmosphere is formed within a predetermined range is disposed in one of the first substrate and the second substrate, and a sealing portion is formed by encapsulating the sealing material through the through-slot.

According to the invention, the through-slot is provided as the sealing portion and the sealing material is formed within a desired range so as to extend over the first substrate and the second substrate with the through-slot as a wall. Therefore, when the sealing portion is formed by depositing the sealing material by a sputtering method, a CVD method, etc., it is possible to prevent the sealing material from being adhered to a contact portion, to which the sealing material should not be adhered, between the fixed electrode and the external electric power supplying means, thereby preventing the poor connection, etc., which provides a reliable sealing and the long life.

Further, the second substrate of the electrostatic actuator according to the invention has an exposed portion which does not come in contact with a third substrate to be laminated, and the through-slot is formed at the exposed portion.

According to the invention, the cavity substrate has an exposed portion which does not come in contact with the nozzle substrate. Therefore, it is possible to dispose a sealing thorough-hole at the exposed portion easily.

Further, the electrostatic actuator according to the invention further comprises a third substrate for blocking the sealing portion.

According to the invention, the third substrate blocks the sealing portion to take measures against the sealing doubly. Therefore, it is possible to carry out sealing more reliably.

Further, in the electrostatic actuator according to the invention, a sealing material clearance groove is provided in the third substrate on a surface which blocks the sealing portion, for preventing the sealing material forced out of the through-slot from contacting the third substrate, and the sealing material clearance groove has a size defined based on the sealing portion.

According to the invention, the third substrate has a sealing material clearance groove. Therefore, even if the sealing material is forced out of the sealing portion, it is possible to carry out the bonding satisfactorily without executing a removing process.

Further, in the electrostatic actuator according to the invention, the sealing material clearance groove is not less than 40 μm in depth.

According to the invention, as the sealing material clearance groove is not less than 40 μm in depth, it is possible to prevent the sealing material from contacting the substrate in a reliable manner.

Further, in the electrostatic actuator according to the invention, at least one of the sealing layers comprises a TEOS layer including TEOS.

According to the invention, one of the sealing layers is made of a TEOS layer including TEOS; therefore, it is possible to reduce a margin to be sealed, which results two-dimensional in miniaturization of the electrostatic actuator. Moreover, since TEOS is superior in chemical resistance, it is possible to form the sealing portion which is superior in chemical resistance.

Further, in the electrostatic actuator according to the invention, at least one of the sealing layers comprises a moisture permeation preventing layer including a substance which is lower in moisture permeation property than TEOS.

According to the invention, one of the sealing layers is made of a moisture permeation preventing layer including a substance which is lower in moisture permeation than TEOS; therefore, it is possible to prevent moisture from entering the gap.

Further, in the electrostatic actuator according to the invention, the moisture permeation preventing layer comprises aluminum oxide, silicon nitride, silicon oxynitride, or aluminum nitride.

According to the invention, as the moisture permeation preventing layer is formed of aluminum oxide, silicon nitride, silicon oxynitride, or aluminum nitride, it is possible to prevent moisture from entering the gap effectively.

Further, in the electrostatic actuator according to the invention, at least one of the sealing layer is a layer comprising tantalum pentoxide, DLC, PDMS, or epoxy resin.

According to the invention, since there is used the above-mentioned material which provides particularly superior preventing effects of vapor or gas permeation, and hence insulating effects, it is possible to improve the sealing effects. Further, when a plurality of the materials are laminated in the efficient order based on their characteristics, it is possible to further improve the sealing effects.

Further, in the electrostatic actuator according to the invention, the sealing portion is formed by one TEOS layer, and one moisture permeation preventing layer laminated on the TEOS layer.

According to the invention, the sealing portion is formed by laminating one moisture permeation preventing layer on one TEOS layer. Therefore, it is possible to prevent moisture from entering the gap effectively. Further, it is possible to decrease the thickness of the sealing portion compared with a single TEOS layer, thereby enabling miniaturization of the electrostatic actuator.

Further, in the electrostatic actuator according to the invention, the sealing portion is formed by one TEOS layer, one moisture permeation preventing layer laminated on the TEOS layer, and another TEOS layer further laminated on the moisture permeation preventing layer.

According to the invention, the sealing portion is formed by laminating one moisture permeation preventing layer on one TEOS layer, and further laminating another TEOS layer on the moisture permeation preventing layer. Therefore, it is possible to prevent moisture from entering the gap effectively, and to form the sealing portion which is superior in chemical resistance. Further, it is possible to decrease the thickness of the sealing portion, thereby enabling miniaturization of the electrostatic actuator.

Further, according to the electrostatic actuator of the invention, the opening of the gap is covered by only one TEOS layer formed as a lower layer.

According to the invention, since the opening is covered by the TEOS layer, it is possible to reduce a margin to be sealed, thereby resulting in two-dimensional miniaturization of the electrostatic actuator. Also, as it takes a long time to form the above-mentioned moisture permeation preventing layer, coating the opening of the gap by the TEOS layer formed as a lower layer enables the sealing portion to be formed in a short time.

Further, in the electrostatic actuator according to the invention, at least one of the sealing layers is a polyparaxylene layer comprising polyparaxylene.

According to the invention, one of the sealing layers is made of a polyparaxylene layer including polyparaxylene which is superior in moisture permeation preventing property and chemical resistance. Therefore, it is possible to further decrease the thickness of the sealing portion, thereby enabling miniaturization of the electrostatic actuator.

Further, a droplet discharging head according to the invention has the above-described electrostatic actuator, and at least a part of a discharging chamber in which liquid is filled constitutes the movable electrode and droplets are discharged through a nozzle communicating with the discharging chamber due to displacement of the movable electrode.

According to the invention, constructing one layer by a low moisture permeation substance and another layer by a superior chemical resistance substance, for example, prevents moisture from entering the space, and carries out the sealing superior in the chemical resistance. Further, the through-slot is provided and the sealing portion is formed by sealing the sealing material in a desired range within the through-slot. Therefore, when the sealing portion is formed by depositing the sealing material by a sputtering method, a CVD method, etc., for example, it is possible to prevent the sealing material from being adhered to a contact portion, to which the sealing material should not be adhered, between the fixed electrode and the external electric power supplying means, thereby preventing the poor connection, etc.

Further, in the droplet discharging head according to the invention, the sealing portion is covered by a substrate having a reservoir formed therein, the reservoir serving as a common liquid chamber from which liquid is supplied to a plurality of discharging chambers.

According to the invention, the reservoir is formed in the substrate for covering the sealing portion; therefore, it is possible to provide the droplet discharging head of a four-layer structure comprising the electrode substrate, the cavity substrate, the reservoir substrate, and the nozzle substrate.

Further, in the droplet discharging head according to the invention, the sealing portion is covered by a substrate having a nozzle formed therein, the nozzle being communicating with the discharging chamber and discharging liquid pressurized in the discharging chamber as droplets.

According to the invention, the nozzles are formed in the substrate for covering the sealing portion. Therefore, it is possible to provide the droplet discharging head of a three-layer structure comprising the electrode substrate, the cavity substrate, and the nozzle substrate.

Further, a droplet discharging apparatus according to the invention has the above-described droplet discharging head mounted thereon.

According to the invention, there is used the droplet discharging head in which a plurality of layers made of a plurality of sealing materials is formed and the sealing portion is formed by providing the through-slot, thereby ensuring the sealing. Therefore, it is possible to provide the droplet discharging apparatus with a long life.

Further, an electrostatic device according to the invention has the above-described electrostatic actuator mounted thereon.

According to the invention, there is used an electrostatic device in which a plurality of layers is made of a plurality of sealing materials, and the sealing portion is formed by providing the through-slot to thereby ensure the sealing. Therefore, it is possible to provide the droplet discharging apparatus with a long life.

Further, a method of manufacturing an electrostatic actuator according to the invention comprises the step of: forming a sealing portion having a plurality of sealing layers laminated one another on one of two substrates disposed so as to be opposed to each other, each of the substrates having an electrode formed thereon, each of the sealing layers being made of a sealing material for isolating a space formed between the two substrates from surrounding atmosphere.

According to the invention, the gap is sealed by the sealing portion having two or more sealing layer, after the cavity substrate and the electrode substrate are bonded to each other. Therefore, constructing one layer by a low moisture permeation substance and one layer by a superior chemical resistance substance, for example, prevents moisture from entering the gap, and provides the sealing portion superior in chemical resistance. Further, forming the sealing layer of TEOS by a plasma CVD method reduces a margin to be sealed, which results in two-dimensional miniaturization of the electrostatic actuator.

Further, in the method of manufacturing an electrostatic actuator according to the invention, at least one of the sealing layers is formed of a TEOS layer comprising TEOS.

According to the invention, one of the sealing layers is formed of the TEOS layer including TEOS. Therefore, it is possible to reduce a margin to be sealed, which results in two-dimensional miniaturization of the droplet discharging head. Also, since TEOS is superior in chemical resistance, it is possible to form the sealing portion which is superior in chemical resistance.

Further, in the method of manufacturing an electrostatic actuator according to the invention, at least one of the sealing layers is formed of a moisture permeation preventing layer comprising a substance which is lower in moisture permeation property than TEOS.

According to the invention, one of the sealing layers comprises a moisture permeation preventing layer including a substance which is lower in moisture permeation property than TEOS. Therefore, it is possible to prevent moisture from entering the gap.

Further, a method of manufacturing an electrostatic actuator according to the invention comprises the steps of: forming a through-slot, through which a sealing material for isolating a space formed between two substrates from surrounding atmosphere is formed within a predetermined range, in one of the two substrates which are disposed so as to be opposed to each other, each of the two substrates having an electrode formed thereon; and encapsulating the sealing material through the through-slot to thereby form the sealing portion.

According to the invention, the through-slot is formed, and then the sealing portion is formed by encapsulating the sealing material within a predetermined range (within the through-slot). Therefore, it is possible to manufacture an electrostatic actuator capable of carrying out sealing in an effective and reliable manner, and having a long life. Moreover, since the sealing portion is formed within only a predetermined range, it is possible to prevent the sealing material from being adhered to a portion to which the sealing material should not be adhered, which eliminates the need for a process of removing the adhered sealing material.

Further, in the method of manufacturing an electrostatic actuator according to the invention, the sealing material is encapsulated through the through-slot by one or plural methods out of a CVD method, a sputtering method, a vapor deposition method, a printing method, a transferring method, and a molding method.

According to the invention, the sealing material is formed by the above-mentioned one or plural methods. Therefore, it is possible to form the sealing material easily by a method tailored to the sealing material. Moreover, it is possible to carry out the sealing to a plurality of the electrostatic actuators or wafers in a lump, which improves the productivity.

Further, in a method of manufacturing a droplet discharging head according to the invention, the droplet discharging head is manufactured using the above-described electrostatic actuator manufacturing method.

According to the invention, the sealing portion is formed within a predetermined range to ensure the sealing. Therefore, it is possible to manufacture a droplet discharging head having a long life.

Further, in a method of manufacturing a droplet discharging apparatus according to the invention, the droplet discharging apparatus is manufactured using the above-described droplet discharging head manufacturing method.

According to the invention, the sealing material is encapsulated through the though-slot, and then there is used a droplet discharging head having a reliable sealing portion formed therein. Therefore, it is possible to manufacture a droplet discharging apparatus having a long life.

Further, in a method of manufacturing an electrostatic device, the electrostatic device is manufactured using the above-described electrostatic actuator manufacturing method.

According to the invention, the sealing material is encapsulated through the though-slot, and then there is used an electrostatic actuator having a reliable sealing portion formed therein. Therefore, it is possible to manufacture an electrostatic device having a long life.

BRIEF DESCRIPTION OF DRAWINGS

FIG. 1 is an exploded view of a droplet discharging head according to a first embodiment.

[FIG. 2]

FIG. 2 is a top view and a sectional view of the droplet discharging head.

FIG. 3 shows a relationship between the through-slot 26 and the lead portion 13 on the electrode substrate 10.

FIG. 4 is a view showing manufacturing processes (first) of the droplet discharging head according to the first embodiment.

[FIG. 5]

FIG. 5 is a view showing manufacturing processes (second) of the droplet discharging head according to the first embodiment.

FIG. 6 shows a relationship between the through-slot 26 and the lead portion 13 on the electrode substrate 10.

[FIG. 7]

FIG. 7 is a view showing manufacturing processes of the reservoir substrate 30.

FIG. 8 is a vertical sectional view of a droplet discharging head according to a fourth embodiment.

FIG. 9 is a top view of the droplet discharging head according to the fourth embodiment.

[FIG. 10]

FIG. 10 is a vertical sectional view showing manufacturing processes of the droplet discharging head (first).

[FIG. 11]

FIG. 11 is a vertical sectional view showing manufacturing processes of the droplet discharging head (second).

FIG. 12 is a vertical sectional view of a droplet discharging head according to a fifth embodiment.

FIG. 13 is a vertical sectional view of a droplet discharging head according to a sixth embodiment.

FIG. 14 is an external view of a droplet discharging apparatus using the droplet discharging head.

FIG. 15 is a view showing one example of main constituent parts of the droplet discharging apparatus.

FIG. 16 is a view of a wavelength variable optical filter using the invention.

BEST MODE FOR CARRYING OUT THE INVENTION

FIRST EMBODIMENT

Figure 1:
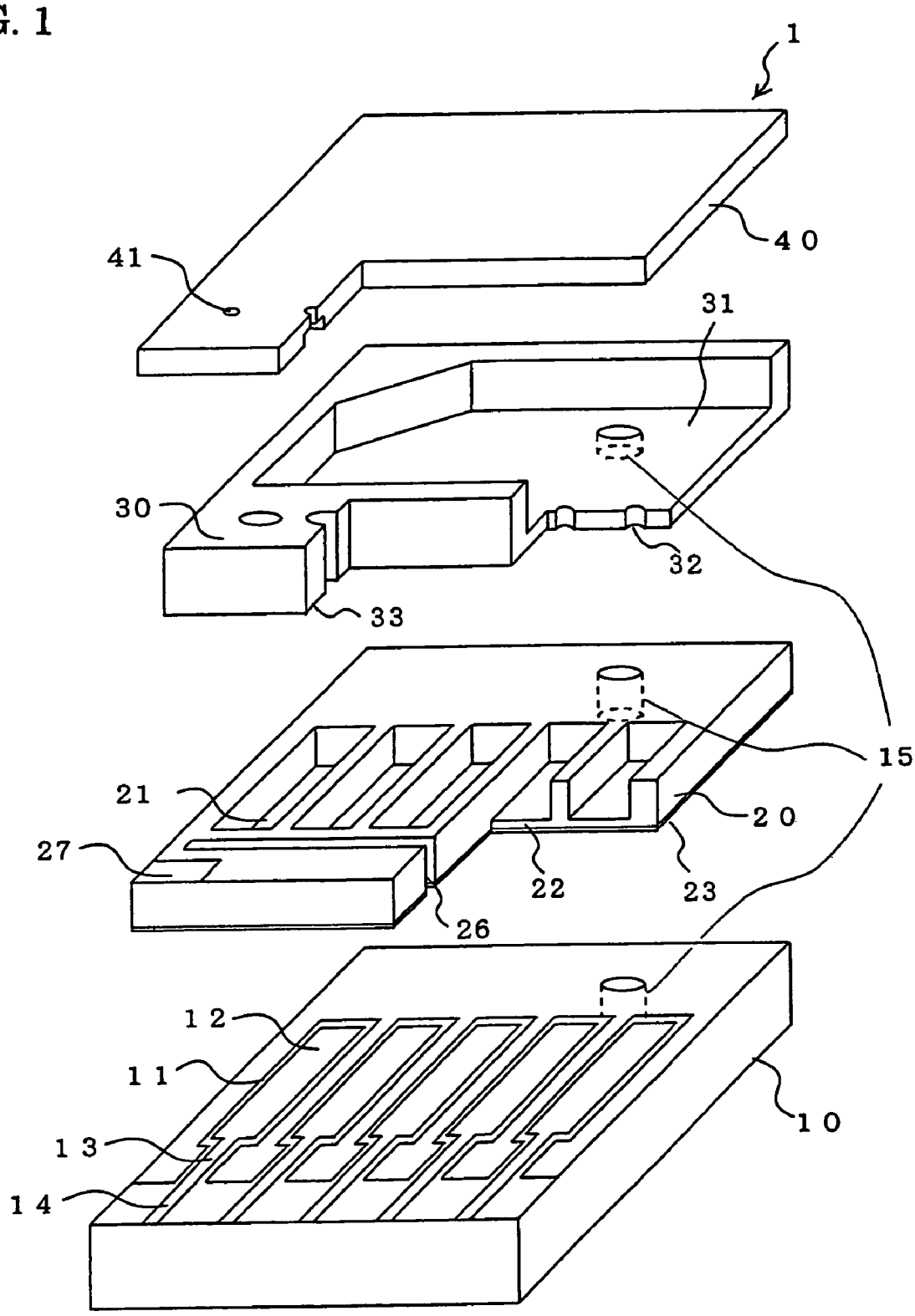
[FIG. 1]

FIG. 1 is an exploded view of a droplet discharging head according to a first embodiment of the invention. FIG. 1 shows a part of the droplet discharging head. In addition, FIG. 2 is a top plan view and a vertical sectional view of the droplet discharging head, respectively. In this embodiment, there is illustrated a face-eject type droplet discharging head as a representative of devices which use an electrostatic actuator driven in an electrostatic manner. (Moreover, the following drawings including FIG. 1 may not provide actual dimensions of respective constitutional members in order to facilitate visualization of the illustrated constitutional members. Each of these drawings shows the constitutional elements while being kept upright.)

As shown in FIG. 1, a droplet discharging head according to this embodiment is constructed by four substrates of an electrode substrate 10, a cavity substrate 20, a reservoir substrate 30, and a nozzle substrate 40, which are laminated from the bottom in the order listed. In this embodiment, the electrode substrate 10 and the cavity substrate 20 are bonded by means of anodic bonding, and not only the cavity substrate 20 and the reservoir substrate 30, but also the reservoir substrate 30 and the nozzle substrate 40 are bonded by means of an adhesive material such as an epoxy resin material.

The electrode substrate 10 as a first substrate is about 1 mm in thickness and is mainly made of borosilicate family heat resistance hard glass substrate, for example. In this embodiment, the electrode substrate 10 is made of glass. However, it may be made of single-crystal silicon. Formed on a surface of the electrode substrate 10 are a plurality of recess portions 11, each of which is about 0.3 μm in depth, for example, corresponding to recess portions 21*a* as discharging chambers 21, described later, of the cavity substrate 20. Then, disposed inside the recess portions 11 (especially on bottoms) are individual electrodes 12 as fixed electrodes, so as to be opposed to the respective discharging chambers 21 (diaphragms 22) of the cavity substrate 20. Further, a lead portion 13 and a terminal portion 14 are integrally provided (hereinafter described as the individual electrode 12, unless otherwise specified). Between the diaphragm 22 and the individual electrode 12, the recess portion 11 forms a gap (air gap, space) 12*a*, in which the diaphragm 22 can be deflected (displaced). The individual electrode 12 is formed by forming ITO (indium tin oxide) on an inside of the recess portion 11 by 0.1 μm in thickness by means of a sputtering method, for example. Further, the electrode substrate 10 has a through-hole, as a liquid taking-in port 15, which serves as a flow passage for taking in liquid supplied from an external tank (not shown).

The cavity substrate 20 as a second substrate is mainly made of single-crystal silicon substrate (hereinafter referred to as the silicon substrate). The cavity substrate 20 has recess portions (bottom walls of which constitute the diaphragms 22 as movable electrodes) as discharging chambers 21 and a through-slot 26, which are formed therein. The through-slot 26 is for forming a sealing portion 26*a* by depositing a sealing material 25 directly on the lead portions 13, as described later. On this occasion, the sealing material 25 comprises, as shown in FIG. 2, two layers of a TEOS layer 25*a* (in this embodiment, an $SiO_2$ layer formed using tetraethyl orthosilicate tetraethoxylilane (ethyl silicate)), and one moisture permeation preventing layer 25*b* of $Al_2O_3$ (aluminum oxide (alumina)), for example. Further, the moisture permeation preventing layer 25*b* is formed on the TEOS layer 25*a*. Only one layer of the TEOS layer 25*a* serves to cover the gap 12*a* and isolate it from the surrounding atmosphere. Further, an insulating film 23 made of a TEOS film is formed by 0.1 μm in thickness on a lower surface of the cavity substrate 20 (surface opposite to the electrode substrate 10) using a plasma CVD (chemical vapor deposition: also referred to as TEOS-pCVD) method. The insulating film 23 serves to electrically insulate the diaphragm 22 and the individual electrode 12 from each other. In this case, the insulating film 23 is made of a TEOS film; however, it may be made of $Al_2O_3$ (aluminum oxide (alumina)). On this occasion, the cavity substrate 20 also has a through-hole constituting the liquid taking-in port 15 (which communicate with the through-hole disposed in the electrode substrate 10), and further has a common electrode terminal 27 through which electric charge opposite in polarity to the individual electrode 7 is supplied to the substrate (the diaphragm 22) from external electric power supplying means (not shown).

The reservoir substrate 30 is mainly made of silicon, for example. The reservoir substrate 30 has a recess portion as a reservoir (common liquid chamber) 31 containing liquid to be supplied to the respective discharging chambers 21. The reservoir substrate 30 also has at a bottom of the recess portion a through-hole (which communicate with the through-hole disposed in the electrode substrate 10) as the liquid taking-in port 15. Further, the reservoir substrate 30 has supply ports 32 for supplying liquid from the reservoir 31 to the respective discharging chambers 21 corresponding to the positions of the respective discharging chambers 21, and has further a plurality of nozzle-communicating holes 33 corresponding to respective nozzles (respective discharging chambers 21). The nozzle-communicating holes 33 constitute flow passages communicating between the respective discharging chambers 21 and the nozzle holes 41 disposed in the nozzle substrate 40. Transferred through the nozzle-communicating hole 33 to the nozzle hole 41 is liquid pressurized in the discharging chamber 21.

The nozzle substrate 40 also is mainly made of silicon, for example. The nozzle substrate 40 has a plurality of nozzle holes 41 formed therein. The respective nozzle holes 41 discharge the liquid transferred from the respective nozzle-communicating holes 33 to the outside as droplets. Forming the nozzle hole 41 in plural steps may improve the straightness of a locus of the droplet discharged. In this embodiment, the nozzle 41 is formed in a two-stepped manner. On this occasion, another diaphragm may be provided in order to buffer a pressure applied to the liquid in the reservoir 31 by the diaphragm 22.

On the other hand, FIG. 2*a* is a top plan view of the droplet discharging head 1 with the cavity substrate 20 in the center, and FIG. 2*b* is a sectional view taken along the one-dotted chain line A-A' of FIG. 2*a*. The cavity substrate 20 is partially cut away, etc. to form a space (this space is hereinafter referred to as the electrode taking-out, port 24), in order to expose the respective terminal portions 14 of the electrode substrate 10 which is bonded to the cavity substrate 20. Then, a driver IC 50 serving as electric power (electric charge) supplying means for the individual electrode 12 is electrically connected to the respective terminal portions 14 in the electrode taking-out port 24, and supplies electric charge to the individual electrodes 12 selectively.

The individual electrodes 12 selected by the driver IC 50 are subjected to a voltage of about 40 V to thereby become positively charged. On this occasion, the diaphragms 22 become negatively charged in a relative manner (in this case, the cavity substrate 20 is supplied with negative electric charge through a common electrode terminal 27 such as an FPC (Flexible Print Circuit), etc.). Thus, between the selected individual electrode 12 and the diaphragm 22, there occurs an electrostatic force, thereby causing the diaphragm 22 to be deflected toward the individual electrode 12, which increases a volume of the discharging chamber 21. Then, stopping supplying the electric charge allows the diaphragm 22 to return to its original state and then, the then volume of the discharging chamber 21 returns to its original state, thereby causing the pressurized liquid to be discharged as a droplet through the nozzle hole 41. This droplet arrives at a recording sheet to carry out printing, etc.

Figure 3:
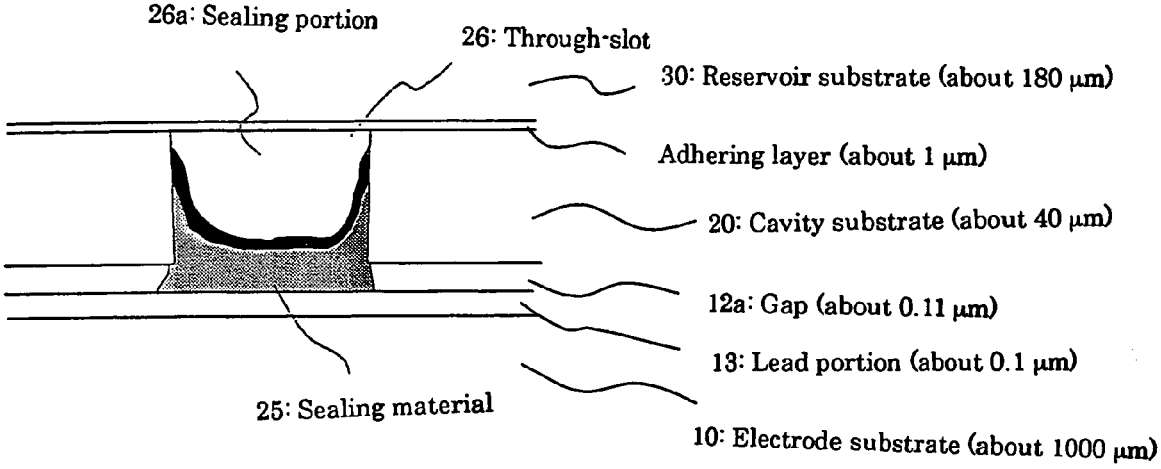
[FIG. 3]

FIG. 3 is a view showing a relationship between the through-slot 26 disposed in the cavity substrate 20, and the lead portion 13 disposed on the electrode substrate 10. In this embodiment, as shown in FIG. 3, the through-slot 26 for exposing the lead portion 13 is opened and provided in the cavity substrate 20. On this occasion, the shallower a width of the through-slot 26, the smaller the droplet discharging head is made. However, if the width is too shallow, the deposition may go wrong. Therefore, it is desirably 10 to 20 μm. However, it is not limited to particularly 10 to 20 μm, since the working is possibly subjected to restrictions depending on the thickness of the cavity substrate 20. For example, it may be 300 μm (0.3 mm), etc. in width, if it is possible to ensure the sealing. Further, in this embodiment, the sealing material 25 to be deposited includes oxide silicon (inorganic compound) which provides excellent electrical insulation and gas-tight sealing property, and is resistant to acid or alkali solution used for washing, etc. A thickness of the deposited sealing material 25 is preferably not less than a size (about 0.18 μm) of the gap 12*a*, for example, even at its thinnest part. It is desirably about 2 to 3 μm or more within a scope which does not affect the bonding with the reservoir substrate 30.

Oxide silicon ($SiO_2$) as the sealing material 25 is deposited in the space (a part of the gap 12*a*) ranging from parts of the lead portions 13 on the electrode substrate 10 to the cavity substrate 20 through an opening of the through-slot 26 by means of a CVD (Chemical Vapor Deposition) method, an (ERC) sputtering method, a vapor deposition method, etc., to thereby form the sealing portion 26*a*, which causes the gap 12*a* to be isolated from the surrounding atmosphere to prevent moisture, foreign substances, etc. from entering.

Conventionally, the sealing material 25 has been formed by applying and hardening an epoxy resin material in an opening of the recess portion 11 between the electrode substrate 10 and the cavity substrate 20 (onto the terminal portions 14). However, in the case of using an epoxy resin material, it is required to sufficiently elongate the lead portion 13 so as to prevent the epoxy resin material from entering between the individual electrode 12 and the diaphragm 22 due to capillary phenomenon, which constitutes a inhibiting factor of miniaturization of the droplet discharging head. To this end, there is a method of depositing a sealing material such as $SiO_2$ onto the opening by a vapor deposition method, a sputtering method, etc. However, the space for the electrode taking-out port 24 is too wide, so it makes it difficult to deposit the sealing material 25 only onto a predetermined part of the electrode taking-out port 24 even if attaching a mask, etc. thereto. Thus, the sealing material 25 may be unfavorably deposited or adhered onto the part to be not deposited. For example, if the sealing material 25 is deposited or adhered onto connecting parts of the driver IC 50 and the terminal portion 14, it is impossible to electrically connect the driver IC 50 and the terminal portions 14 to each other, which may lead to the poor connection (the poor conductivity).

A sealing material removing process is additionally needed to prevent the poor connection. This process not only needs a lot of time, but also causes foreign substances, which affect the other members. Therefore, in this embodiment, in order to deposit, etc. and then encapsulate the sealing material 25 only onto a desired portion in a selective manner to form the sealing portion 26*a* effectively, the through-slot 26 is opened at locations corresponding to the desired portion. As a result, it is possible to provide a mask firmly attached thereto with the through-slot 26 being a surrounding wall to form the sealing portion 26*a*, while the sealing material 25 is deposited only onto the desired portion (directly on the lead portions 13). This alone provides sufficient effects, but further in this embodiment, the opening of the sealing portions 26*a* is blocked by the reservoir substrate 30, and then the reservoir substrate 30 is bonded to the cavity substrate 20 by an adhesive material to thereby form a so-called cover, which provides the reliable sealing.

Figure 4:
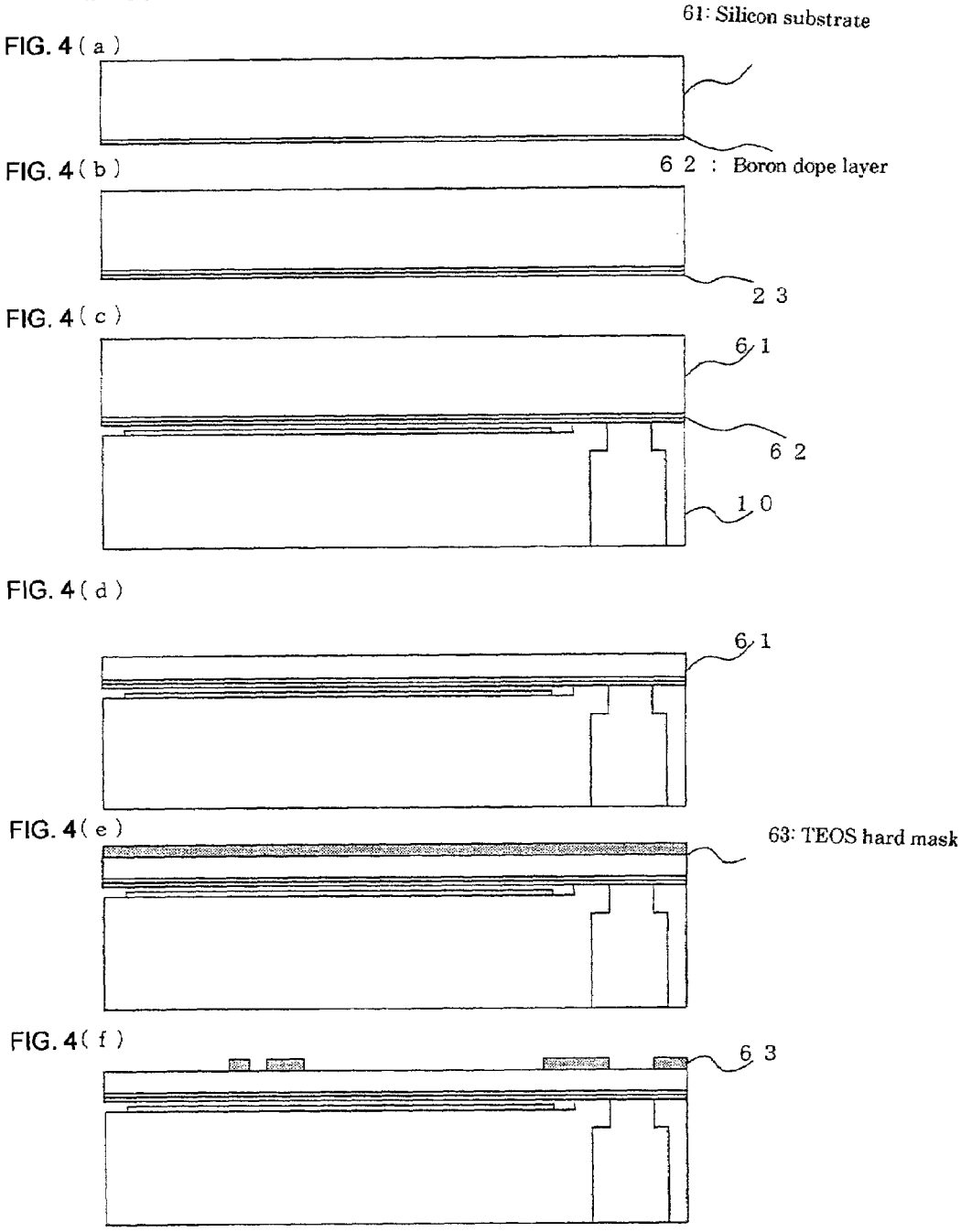
[FIG. 4]

FIGS. 4 and 5 are views showing manufacturing processes of the droplet discharging head 1 according to the first embodiment. Referring first to FIGS. 4 and 5, there are illustrated manufacturing processes of the droplet discharging head 1. Moreover, members for the several droplet discharging heads 1 are formed simultaneously per one wafer, only a part of which is, however, shown in FIGS. 4 and 5.

(a) A silicon substrate 61 is mirror-polished at its one surface (surface bonded to the electrode substrate 10), to thereby form a substrate which is 220 μm, for example, in thickness (formed into the cavity substrate 20). Next, the surface of the silicon substrate 61 on which a boron dope layer 62 is formed is set in a quartz boat opposite to a solid diffusion source consisting primarily of $B_2O_3$. Further, the quartz boat is set in a vertical furnace, followed by making an inside of the furnace into a nitrogen atmosphere with its temperature increased up to 1050° C. and kept for seven hours. Accordingly, boron is diffused into the silicon substrate 61 to thereby form the boron dope layer 62. The taken-out silicon substrate 61 has at its one surface the boron dope layer 62, on which a boron compound ($SiB_6$: hexaboron silicide) (not shown) is formed. Oxidizing this for one hour and thirty minutes in oxygen and water vapor atmosphere at 600° C. enables the boron compound to be chemically changed to $B_2O_3$+$SiO_2$ which can be subjected to etching by fluorinated acid solution. Thereafter, $B_2O_3$+$SiO_2$ is etched and removed using the fluorinated acid solution.

(b) The insulating film 14 is formed by 0.1 μm on the surface with the boron dope layer 62 by means of a plasma CVD method under conditions of 360° C. in processing temperature during film-formation, 250 W in high frequency output, and 66.7 Pa (0.5 Torr) in pressure, as well as 100 $cm^3$/min (100 sccm) in TEOS flow rate and 1000 $cm^3$/min (1000 sccm) in oxygen flow rate, as gas flow rate.

(c) The electrode substrate 10 is prepared by another process different from the above-mentioned processes (a) and (b). On one surface of a glass substrate of about 1 mm in thickness, a recess portion 11 of about 0.3 μm in depth is formed. After having formed the recess portion 11, the individual electrodes 12 of 0.1 μm in thickness are simultaneously formed using a sputtering method, for example. Finally, a hole used for the liquid taking-in port 15 is formed by means of sandblasting or cutting. As a result, there is produced the electrode substrate 10. Then, after heating the silicon substrate 61 and the electrode substrate 10 up to 360° C., a voltage of 800 V is applied thereto with a negative terminal connected to the electrode substrate 10 and with a positive terminal connected to the silicon substrate 61, thereby carrying out anodic bonding.

In the substrate already bonded to each other due to the anodic bonding, the other surface of the silicon substrate 61 is subjected to a grinding work down to about 60 μm in thickness. Thereafter, the silicon substrate 61 is subjected to anisotropic wet etching (hereinafter referred to as wet etching) by about 10 μm using a potassium hydroxide solution of 32 wt % in concentration in order to remove the work-affected layer. This reduces the thickness of the silicon substrate 61 down to about 50 μm.

(e) Next, a oxide silicon-made TEOS hard mask (hereinafter referred to as TEOS hard mask) 63 is formed by means of a plasma CVD method onto the wet etched surface. The film-formation is carried out by 1.5 μm under film-forming conditions of 360° C., for example, in processing temperature during the film-formation, 700 W in high frequency output, and 33.3 Pa (0.25 Torr) in pressure, as well as 100 $cm^3$/min (100 sccm) in TEOS flow rate and 1000 $cm^3$/min (1000 sccm) in oxygen flow rate, as gas flow rate. The film-formation using TEOS can be carried out at a relatively low temperature, thereby suppressing the heating of the substrates as much as possible.

(f) After forming the TEOS hard mask 63, the TEOS hard mask 63 is subjected to resist-patterning in order to etch a part of the TEOS hard mask 63 which is made into the discharging chamber 21, the through-slot 26, and the electrode taking-out port 24. Then, etching the part of the TEOS hard mask 63 using a fluorinated acid solution until the part of the TEOS hard mask 63 is removed, to thereby subject the TEOS hard mask 63 to patterning, which causes the silicon substrate 61 to be exposed at its part. The resist is stripped off after etching.

(g) Next, the bonded substrates are dipped in a potassium hydroxide solution of 35 wt % in concentration, and then is subjected to anisotropy wet etching (referred to as wet etching) until the part of the substrates corresponding to the discharge chamber 5, the through-slot 26, and the electrode taking-out port 24 becomes about 10 μm in thickness. Further, the bonded substrates are dipped in a potassium hydroxide solution of 3 wt % in concentration and then continued to be subjected to the wet etching until the boron dope layer 62 is exposed and hence the etching extremely decelerates to thereby be expected to sufficiently achieve the etching stop. In this manner, carrying out the etching using two kinds of the potassium hydroxide solutions which are different in concentration from each other suppresses roughening of the surface of the diaphragm 22 formed at the part of the substrate corresponding to the discharging chambers 21, thereby improving the thickness accuracy down to not more than 0.80±0.05 μm. This enables the discharging property of the droplet discharging head 1 to be stabilized.

(h) After the wet etching has been finished, the bonded substrates are dipped in the fluorinated acid solution to thereby strip the TEOS hard mask 63 off the surface of the silicon substrate 61. Then, in order to remove a part of the boron dope layer 62 corresponding to the through-slot 26 and the electrode taking-out port 24, a silicon mask which is opened at its part corresponding to the through-slot 26 and the electrode taking-out port 24 is attached to a surface of the bonded substrates on a side of the silicon substrate 61. Further, the bonded substrates are subjected to an RIE dry etching (anisotropy dry etching) for 30 minutes under condition of, for example, 200 W in RF power, 40 Pa (0.3 Torr) in pressure, and 30 $cm^3$/min (30 sccm) in $CF_4$ flow rate, and then plasma is applied to only its part corresponding to the through-slot 26 and the electrode taking-out port 24, thereby providing an opening. On this occasion, for example, in order to improve the alignment accuracy between the bonded substrates and the silicon mask, the silicon mask may be placed due to pin-alignment of penetrating a pin into the bonded substrates and the silicon mask.

(i) Further, the silicon mask which is opened at a part corresponding to the through-slot 26 is attached to a surface of the bonded substrates on a side of the silicon substrate 61. Also in this process, it is recommended to use the pin alignment. Further, taking the alignment accuracy, etc. into consideration, the opening of the silicon mask is preferably made smaller than that of the through-slot 26 such that the sealing material 25 is not adhered to a surface of the cavity substrate 20 (a bonded surface with the reservoir substrate 30). Then, the sealing material 25 (the TEOS layer 25*a* and the moisture permeation preventing layer 25*b*) is deposited through the through-slot 26 by means of a plasma CVD method using TEOS, a vapor deposition method, a sputtering method, etc to form the sealing portion 26*a*. The thickness of the deposited sealing material 25 is desirably about 2 to 3 μm or more at its thinnest part within a scope which does not affect the bonding with the other substrate, but is not specifically limited thereto, as described above, because the size of the gap 12*a* is about 0.2 μm. On this occasion, if the gap 12*a* is blocked by only the TEOS layer 25*a* which is great in deposition volume per unit time, and further the moisture permeation preventing layer 25*b* is formed thereon, it is possible to shorten the formation time and to carry out the sealing effectively.

(j) After the sealing is finished a mask which is opened at a part corresponding to the common electrode terminal 27, for example, is attached to a surface of the bonded substrates at a side of the silicon substrate 61. Then, the surface of the bonded substrates is subjected to sputtering, etc. with platinum (Pt), for example, as a target to form the common electrode terminal 27.

(k) The reservoir substrate 30 which is preliminarily prepared in another process is adhered and bonded onto a surface of the bonded substrates on a side of the cavity substrate 20 using an epoxy adhesive material, for example. Then, the driver IC 50 is connected to the terminal portions 14. Further, the nozzle substrate 40 which is prepared in another process is adhered onto a surface of the bonded reservoir substrate 30 using the epoxy adhesive material, for example. Finally, dicing the bonded substrates along a dicing line provides the individual droplet discharging heads 1, which leads to completion of the droplet discharging head.

As described above, according to the first embodiment, the sealing portion 25 is constructed by the TEOS layer 25*a* and the moisture permeation preventing layer 25*b* which are different in material from each other; therefore, it is possible to prevent moisture from entering the gap 12*a* more effectively. Further, only one layer of the TEOS layer 25*a* serves to cover the gap 12*a* to thereby isolate it from the surrounding atmosphere, and then the moisture permeation preventing layer 25*b* is deposited thereon. Therefore, it is possible to make the moisture permeation preventing layer 25*b* which requires a long film-forming time to be thinner, and shorten the formation time. Then, the sealing portion 26*a* comprising the sealing material 25 is formed directly on only the lead portion 13 through the through-slot 26 disposed in the cavity substrate 20, to thereby isolate the gap 12*a* (space) formed between the diaphragm 22 and the individual electrode 12 from the surrounding atmosphere. Therefore, it is possible to form the sealing portion 26*a* effectively and reliably due to deposition, etc. within a selected range (a range of the through-slot) with the through-slot 26 being a wall. Moreover, in the sealing portion 26*a* forming step, since a part of the electrode taking-out port 24 is masked by the silicon mask, the sealing material 25 is not additionally adhered to the terminal portions 14. Thus, even if the removing process is not carried out, it is possible to prevent the poor connection without damaging the electric connection with the external electric power supply means such as the driver IC 50.

SECOND EMBODIMENT

Figure 6:
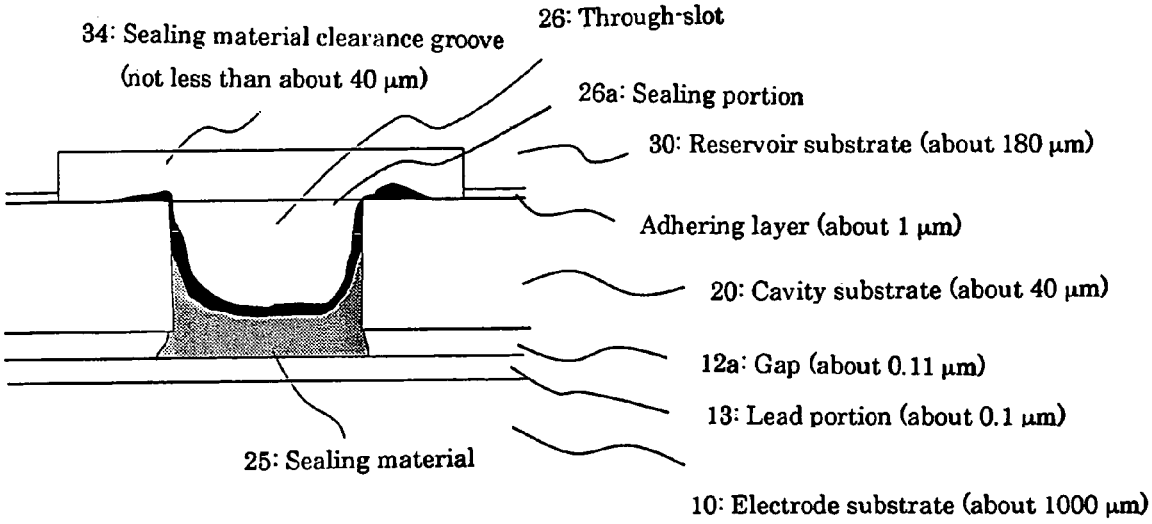
[FIG. 6]

FIG. 6 is a view showing a relationship between the through-slot 26 disposed in the cavity substrate 20 and the lead portion 13 disposed on the electrode substrate 10, according to a second embodiment of the invention. The above-mentioned first embodiment is illustrated assuming that the sealing material 25 is not adhered to a bonded surface between the cavity substrate 20 and the reservoir substrate 30. However, in the case where the attached silicon mask is separated from the cavity substrate 20 by a gap without close contact, or the alignment of the silicon mask is off, for example, it cannot be said that the sealing material 25 is not adhered to the bonded surface. Even if this happens, in this embodiment, a sealing material clearance groove 34 being preliminarily formed on the reservoir substrate 30 prevents the sealing material 25 from contacting the reservoir substrate 30, which prevents the poor bonding.

On this occasion, the sealing material clearance groove 34 is preferably wider by about 100 μm than the opening of the through-slot 26, for example, depending on the size of its opening. Further, its depth is preferably not less than 40 μm.

FIG. 7 is a view showing processes of manufacturing the reservoir substrate 30 according to the second embodiment. Referring to FIG. 7, there is illustrated the reservoir substrate 30 provided with the sealing material clearance groove 34.

(a) There is formed an etching mask 72 made of oxide silicon on the whole surface of a silicon substrate 71 due to thermal oxidation, etc., followed by subjecting the surface of the silicon substrate 71 to resist-patterning and further to etching by a fluorinated acid solution, etc. As a result, the etching mask 72 is removed from one surface of the silicon substrate 71 at locations corresponding to the liquid taking-in port 15, a supply port 32, the nozzle-communicating hole 33, and the sealing material clearance groove 34.

(b) Next, the silicon substrate 71 is subjected to dry etching using ICP (inductively coupled plasma) electric discharge, for example, to thereby form a recess portion 73 as the liquid taking-in port 15, a recess portion 74 as the supply port 32, a recess portion 75 as the nozzle-communicating hole 33, and the sealing material clearance groove 34. In this embodiment, the dry etching by the ICP electric discharge is employed; however, there may be employed the wet etching using a potassium hydroxide (KOH) solution, for example.

(c) A support substrate 76 made of glass and silicon, for example, is adhered to a surface on which the sealing material clearance groove 34 is formed, using a resist, etc.

(d) Further, the other surface of the silicon substrate 71 is subjected to resist-patterning and further to etching using a fluorinated acid solution, etc. As a result, the etching mask 72 is removed from the other surface of the silicon substrate 71 opposite to a side of the support substrate 76 at locations corresponding to the reservoir 31 and the nozzle-communicating holes 33.

(e) Then, the silicon substrate 71 is subjected to dry etching using ICP electric discharge, for example, to thereby form a recess portion 77 as the reservoir 31 and a recess portion 78 as the nozzle-communicating hole 33 on the other surface of silicon substrate 71 opposite to a side of the support substrate 76.

(f) Subsequent dry etching using ICP electric discharge causes the recess portion 77 as the reservoir 31 to communicate with the recess portions 73 and 74, and then causes the recess portions 78 as the nozzle-communicating holes 33 to communicate with the recess portion 75.

(g) Finally, by detaching the support substrate 76 from the silicon substrate 71, and then removing all the etching masks 72 using a fluorinated acid solution, for example, the reservoir substrate 30 is completed.

As described above, according to the second embodiment, when the cavity substrate 20 having the through-slot 26 (the sealing portion 26*a*) formed therein and the reservoir substrate 30 are bonded to each other, the sealing material clearance groove 34 is preliminarily formed in the reservoir substrate 30 such that the sealing material 25 does not contact the reservoir substrate 30. Therefore, there cannot be caused the poor connection, even if the sealing material 25 is adhered to the bonded surface between the cavity substrate 20 and the reservoir substrate 30. This eliminates the need for carrying out the process of removing the adhered material, and then prevents the foreign substances caused in the removing process from adversely affecting the manufacture and the performance of the droplet discharging head. Thus, it is possible to efficiently manufacture the droplet discharging head and improve the yield.

THIRD EMBODIMENT

In the above-mentioned embodiment, the TEOS layer 25*a* and the moisture permeation preventing layer 25*b* are employed as the sealing material 25. Oxide silicon is the best material because it is superior in the resistance to liquid or gas which is used in the subsequent processes, but is not limited thereto. Further, the moisture permeation preventing layer 25*b* may include, for example, not only $Al_2O_3$ (aluminum oxide (alumina)), but also silicon nitride (SiN) and silicon oxynitride (SiON). Also, it may include substances, such as $Ta_2O_5$ (tantalum pentoxide), DLC (diamond like carbon), polyparaxylylene, PDMS (polydimethylsilxane: a kind of silicone rubber), an inorganic or organic compound including epoxy resin, etc., which are relatively lower in molecular mass and can be deposited by means of a vapor deposition method, a sputtering method, etc., and further are impermeable to moisture. Generally, the inorganic compound material is superior in a gas barrier property, a vapor barrier property, a process resistance, a heat resistance, etc., whereas the organic compound material has a low-stress property, and hence is capable of being easily adjusted in thickness to a predetermined value using a low temperature process.

In the above description, the TEOS layer 25*a* and the moisture permeation preventing layer 25*b* are laminated. However, plural kinds of the sealing materials may be laminated in the order of exhibiting their characteristics effectively based on their characteristics to form the sealing portion 26*a*. For example, the inorganic compound material may be first deposited as a lower layer directly on the lead portion 13, after which the organic compound material may be deposited so as to cover the inorganic compound material, as a coating material, which provides a reliable sealing. Therefore, even if deposition of the inorganic compound material generates pin holes, their pin holes can be coated by the organic compound material, which provides a more reliable sealing effect. Further, for example, the sealing portion 26*a* may be formed of two layer-sealing material 25 comprising a lower layer of $Al_2O_3$ and an upper layer of $SiO_2$ having a process resistance. Also, for example, if the sealing portion 26*a* is formed by depositing a sealing material of DLC as a bottom layer, laminating an $Al_2O_3$ material and an $SiO_2$ material in the order named, and then depositing a polyplaraxylene material as a top layer, there can be formed the sealing material 25 which is superior in vapor permeability, and has a process resistance (chemical resistance) to thereby reliably provide gas tight sealing even if carrying out washing by an acid or alkali solution, etc.

An SiN layer or an SiON layer can be formed by means of a vapor deposition method, a sputtering method, etc., as is the case with the $SiO_2$ layer. An $Al_2O_3$ material is superior in vapor permeability resistance and hence is suitable for the sealing material 25. The $Al_2O_3$ material is deposited in the through-slot 26 by means of an ECR sputtering method, for example. On this occasion, an ALD/CVD method (ALD (Atomic Layer Deposition) and CVD are alternated) can perform deposition, etc. while improving its film density conveniently.

A $Ta_2O_5$ material is hard, and is particularly superior in an ink resistance exhibited in discharging ink. The $Ta_2O_5$ material is deposited in the through-slot 26 by means of an ECR sputtering, for example. Also, a DLC material is hard, and further has an effect of reducing hydroxyl existing on surfaces of the diaphragms 22 and the individual electrodes 12, which can prevent possible hydrogen bonding between the diaphragm 22 and the individual electrode 12. The DLC material is deposited through the through-slot 26 by means of an ECR sputtering method or a CVD method.

Moreover, a polypalaxylylene material is superior in a repellency and has a chemical resistance. Further, it has a rubber elasticity and a low-stress property, and can be used for all type of films. The polypalaxylylene material is deposited through the through-slot 26 by a vapor deposition method, for example. A PDMS material is low in contraction after formation, thereby providing a high dimensional accuracy. Thus, there occurs no gap. Printing and molding enables the sealing material 25 of PDMS to be encapsulated in the through-slot 26. Then, since an epoxy resin material is unfavorably spread out into the gap 12 as described above, it is preferably employed as a coating material when forming the sealing portion 26*a* by a plurality of the sealing materials 25, for example. Particularly, it is convenient as a coating material because of its superior water resistance and chemical resistance. Further, it can be hardened and hence formed even in a low temperature.

FOURTH EMBODIMENT

Figure 8:
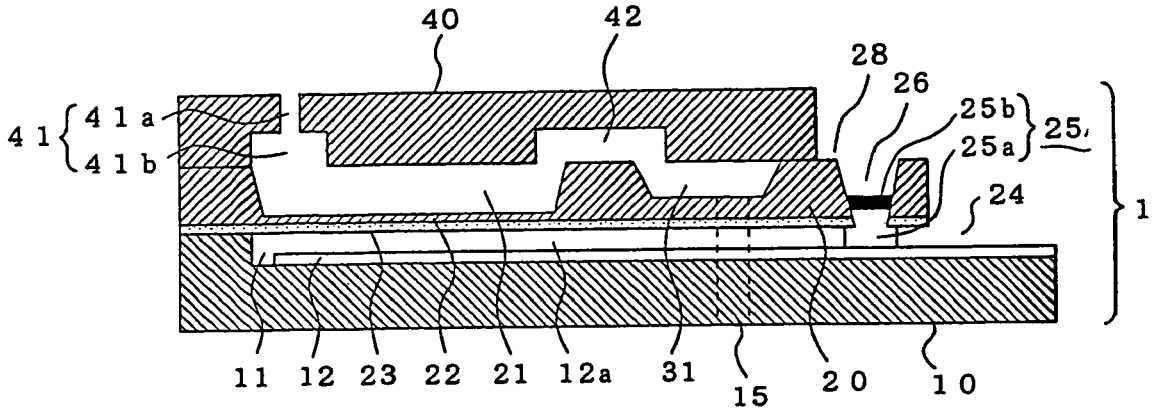
[FIG. 8]

FIG. 8 is a vertical sectional view of a droplet discharging head according to a fourth embodiment of the invention. Moreover, in FIG. 8, a circuit for driving the diaphragm 22 is omitted. A droplet discharging head shown in FIG. 8 is of an electrostatic driving-face eject type. The droplet discharging head 1 according to the fourth embodiment is mainly constituted by the cavity substrate 20, the electrode substrate 10, and the nozzle substrate 40 which are bonded mutually. Moreover, the nozzle substrate 40 is bonded onto one surface of the cavity substrate 20, whereas the electrode substrate 10 is bonded to the other surface of the cavity substrate 20.

The nozzle substrate 40 is made of silicon, for example, and has formed therein a nozzle hole 41 comprising a first cylindrical nozzle hole 41*a*, and a second cylindrical nozzle hole 41*b* which is communicated with the first nozzle hole 41*a*, and is greater in diameter than the first nozzle hole 41*a*. The first nozzle hole 41*a* is formed so as to open to a droplet discharging surface 10 (opposite to a bonded surface 11 with the cavity substrate 20), whereas the second nozzle hole 41*b* is formed so as to open to the bonded surface 11 with the cavity substrate 20. The nozzle substrate 40 has formed therein recess portions as orifices 42 communicating discharging chambers 21, described later, with a reservoir 31. Moreover, the recess portions serving as the orifices 42 may be formed in the cavity substrate 20.

The cavity substrate 20 is made of a single-crystal silicon, for example, and has a plurality of recess portions serving as the discharging chambers 21 with a bottom wall as the diaphragm 22. Moreover, a plurality of the discharging chambers 21 is assumed to be formed in parallel with one another in a direction from the front side to the back side of sheet of FIG. 1. The cavity substrate 20 has formed therein a recess portion serving as a reservoir 31 for supplying droplets of ink, etc. to the respective discharging chambers 21. In the droplet discharging head 1 shown in FIG. 8, the reservoir 31 is formed of a single recess portion, and one orifice 42 is formed for each of the discharging chambers 21.

Further, an insulating film 23 is formed on a surface of the cavity substrate 20 onto which the electrode substrate 10 is bonded. This insulating film 23 is for preventing dielectric breakdown or shot-circuiting when driving the droplet discharging head 1. A droplet protecting film (not shown) is generally formed on a surface of the cavity substrate 20 onto which the nozzle substrate 40 is bonded. This droplet protecting film is for preventing the cavity substrate 20 from being etched due to droplets from the inside of the discharging chambers 21 and the reservoir 31.

The electrode substrate 10 made of borosilicate glass, for example, is bonded to the surface of the cavity substrate 20 on a side of the diaphragms 22. The electrode substrate 10 has formed thereon a plurality of individual electrodes 12 so as to be opposed to the diaphragms 22. These individual electrodes 12 are formed by sputtering ITO (Indium Tin Oxide) into the inside of the recess portions 11 formed in the electrode substrate 10. Further, the electrode substrate 10 has formed therein a liquid taking-in port 15 which communicate with the reservoir 31. This liquid taking-in port 15 is connected to a hole disposed on the bottom wall of the reservoir 31, through which droplet of ink or the like is supplied to the reservoir 31 from the outside.

Moreover, in the case where the cavity substrate 20 is made of a single-crystal silicon, and the electrode substrate 10 is made of borosilicate glass, the cavity substrate 20 and the electrode substrate 10 can be bonded to each other by means of anodic bonding.

On this occasion, a description will be given of an operation of the droplet discharging head 1 shown in FIG. 8. A driving circuit (not shown) is connected to the cavity substrate 20 and the individual electrodes 12, respectively. When the driving circuit applies a pulse voltage between the cavity substrate 20 and the electrode 12, the diaphragm 22 is deflected on a side of the individual electrode 12, which causes the droplet such as ink contained inside the reservoir 31 to flow into the discharging chamber 21. Moreover, in the first embodiment, the individual electrode 12 and the diaphragm 22 (the insulating film 23) are abutted to each other when the diaphragm 22 is deflected. Then, when there is no voltage applied between the cavity substrate 20 and the individual electrode 12, the diaphragm 22 returns to its original state, thereby increasing a pressure inside the discharging chamber 21, which causes droplet such as ink to be discharged from nozzle hole 41.

The droplet discharging head 1 according to the fourth embodiment, there is the gap 12*a* between the diaphragm 22 and the individual electrode 12 (or the recess portion 11). Moreover, the gap 12*a* is realized by a space formed between the diaphragm and the individual electrode 12, and then extends up to the electrode taking-out portion 24. Moreover, the electrode taking-out portion 24 is for connecting the individual electrode 12 and the driving circuit to each other.

Further, the droplet discharging head 1 according to the fourth embodiment has an exposed portion 28, which is not connected to the nozzle substrate 40, on a surface of the cavity substrate 20 on which the nozzle substrate 40 is bonded. The exposed portion 28 has a through-slot 26 in which a sealing portion 26*a* for sealing the gap 12*a* is to be formed. The through-slot 26 is formed so as to penetrate the cavity substrate 20 from its upper surface to its lower surface.

The sealing portion 26*a* is for preventing moisture, etc. from entering the gap 12*a*, as described above, to thereby be adhered to a bottom surface of the diaphragm 22 and a surface of the individual electrode 12, and hence preventing its electrostatic attractive force and its electrostatic repulsive force from lowering.

In the fourth embodiment, the sealing material 25 of the sealing portion 26*a* is constituted by two layers of the single TEOS layer 25*a* and the single moisture permeation preventing layer 25*b*. Moreover, the moisture permeation preventing layer 25*b* is formed on the TEOS layer 25*a*. The TEOS layer 25*a* covers the opening of the gap 12*a* with a single layer. The opening of the gap 12*a* means a part of the gap 12*a* which communicate with the outside at a lower portion of the through-slot 26

The TEOS layer 25*a* is made of TEOS, and is formed by means of a plasma CVD method, for example. In the case where the TEOS layer 25*a* is formed by the plasma CVD method, TEOS hardly enters the gap 12*a*, thereby reducing the extension of the TEOS layer 25*a*.

Further, the moisture permeation preventing layer 25 is made of a material which has lower moisture permeation than TEOS, that is, aluminum oxide ($Al_2O_3$), silicon nitride (SiN), silicon oxynitride (SiON), and aluminum nitride (AlN), for example, and further is formed by means of a sputtering method, and a CVD method, etc.

Figure 9:
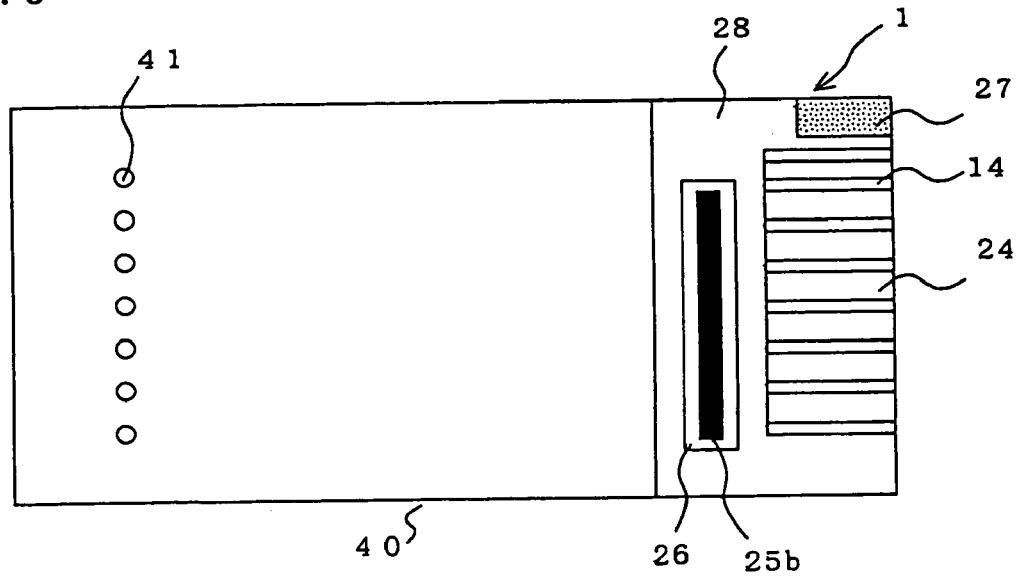
[FIG. 9]

FIG. 9 is a top view of the droplet discharging head according to an embodiment of the invention.

As shown in FIG. 9, disposed at an exposed portion 28 of the cavity substrate 20 is the through-slot 26, in which the TEOS layer 25*a* (not shown in FIG. 9) and the moisture permeation preventing layer 25*b* are formed. In the first embodiment, the single through-slot 26 is formed to cover a plurality of the gaps 12*a* (the individual electrodes 12*a*) in order to seal the plurality of the gaps 12*a* in a lump. In the first embodiment, the single through-slot 26 is formed; however, the through-hole 26 may be disposed for each of the electrodes 12*a*.

Moreover, in FIG. 9, there is illustrated a common electrode terminal 27 for connecting the cavity substrate 20 and the driving circuit with each other.

FIGS. 10 and 11 are vertical sectional views showing manufacturing processes of the droplet discharging head according to an embodiment of the invention. FIGS. 10 and 11 illustrate processes of manufacturing the droplet discharging head 1 shown in FIGS. 8 and 9. A method of manufacturing the cavity substrate 20 and the electrode substrate 10 is not limited to that of FIGS. 10 and 11.

First, a glass substrate made of borosilicate glass, etc. is subjected to etching using a fluorinated acid using an etching mask of gold and chromium, for example, which provides the recess portions 11. The recess portions 11 are slightly larger than the individual electrodes 12 and formed plurally.

Then, the individual electrodes 12 made of ITO (indium tin oxide) is formed inside the recess portions 11 by a sputtering method, for example.

Thereafter, a hole portion 15*a* as the liquid taking-in port 15 is formed by drilling, etc., which provides the electrode substrate 10 (FIG. 10*a*).

Next, both sides of the silicon substrate 20*a* of 525 μm in thickness is subjected to mirror polishing, before one surface of the silicon substrate 20*a* is subjected to plasma CVD, to form thereon an insulating film 23 made of a silicon dioxide (TEOS) film of 0.1 μm in thickness, for example, (FIG. 10*b*). Moreover, before forming the silicon dioxide layer 31, a boron dope layer may be formed for the purpose of etching stopping. Forming the diaphragm 22 by a boron dope layer provides the diaphragm 22 with a high thickness accuracy.

Then, the silicon substrate 20*a* shown in FIG. 10*b* and the electrode substrate 10 shown in FIG. 10*a* are heated up to 360° C., and a voltage of about 800 V is applied thereto with a positive terminal connected to the silicon substrate 20*a* and with a negative terminal connected to the electrode substrate 10, which provides anodic bonding (FIG. 10*c*).

After anodic bonding the silicon substrate 20*a* and the electrode substrate 10, a bonded substrate obtained in a process of FIG. 10*c* is subjected to etching by using a potassium hydroxide solution, etc., thereby making the entire thickness of the silicon substrate 20*a* thin down to 140 μm, for example (FIG. 10*d*). Moreover, the silicon substrate 20*a* may be thinned by means of machining operations. In this case, it is desirable to carry out light etching using a potassium hydroxide solution, etc. in order to remove the work-affected layer after the machining operations.

Then, an entire upper surface of the silicon substrate 20*a* (opposite to a surface on which the electrode substrate 10 is bonded) is subjected to plasma CVD to thereby form a TEOS film of 1.5 μm in thickness, for example.

On this TEOS film is patterned a resist for forming thereon recess portions 21*a* as the discharging chambers 21, a recess portion 31*a* as the reservoir 31, and a recess portion as the through-slot 26, where the TEOS film is removed by etching.

Subsequently, the silicon substrate 20*a* is etched using a potassium hydroxide solution, etc. to thereby form the recess portions 21*a* as the discharging chambers 21, the recess portion 31*a* as the reservoir 31, and the recess portion as the through-slot 26 (FIG. 11*e*). On this occasion, an upper potion of the electrode taking-out portion 24 is preliminarily etched to be thinned. Moreover, the wet etching process of FIG. 11*e* can include, for example, first using a potassium hydroxide solution of 35 wt %, and then a potassium hydroxide solution of 3 wt %, which suppresses roughening of the surface of the diaphragm 22.

After the etching of the silicon substrate 20*a* is completed, the bonded substrate is etched using a fluorinated acid solution to thereby remove the TEOS film formed on the silicon substrate 20*a*. Also, the hole portion 15*a* of the electrode substrate 10 as the liquid taking-in port 15 is laser-textured to cause the liquid taking-in port 15 to penetrate through the electrode substrate 10.

Thereafter, a liquid protecting film (not shown) of TEOS, etc. is desirably formed by 0.1 μm, for example, in thickness by means of a CVD method, for example, on a surface of the silicon substrate 20*a* on which the recess portion 21*a*, etc. as the discharging chambers 21 are formed.

Then, the through-slot 26 is penetrated by RIE (reactive ion etching), etc., thereby causing the electrode taking-out portion 24 to be opened. Also, the silicon substrate 20*a* is machined or laser-textured to thereby cause the liquid taking-in port 15 to penetrate up to the recess portion 31*a* as the reservoir 31 (FIG. 11*f*).

Next, the TEOS layer 25*a* is formed inside the through-slot 26 by means of a plasma CVD method, for example. On this occasion, as described above, the opening of the gap 12*a* is covered by only the TEOS layer 25*a* so as to close the gap 12*a* hermetically. Moreover, the TEOS layer 25*a* may be replaced with a polyparaxylene layer made of polyparaxylene. Polyparaxylene is a crystalline polymer resin, and is superior in moisture permeation preventing property and chemical resistance.

Next, the moisture permeation preventing layer 25*b* of aluminum oxide is formed on the TEOS layer 25*a* by means of a sputtering method or a CVD method, for example (FIG. 11*g*). Since it takes a long time to form the moisture permeation preventing layer 25*b* of aluminum oxide by means of a sputtering method or a CVD method; the moisture permeation preventing layer 25*b* is desirably formed by 100 to 500 nm, for example, in thickness. Further, the moisture permeation preventing layer 25*b* can be made of not only aluminum oxide, but also silicon nitride, silicon oxynitride, and aluminum nitride, etc.

In this manner, the sealing portion 26*a* consisting of two layers of the TEOS layer 25*a* and the moisture permeation preventing layer 25*b* is formed.

Subsequently, the nozzle substrate 40 on which the recess portions as the nozzle holes 41 and the orifice 42 are formed by ICP (inductively coupled plasma) electric discharge, etching, etc. is bonded to the silicon substrate 20*a* (the cavity substrate 20) using an adhesive material, etc. (FIG. 11*i*).

Finally, the bonded substrate comprising the cavity substrate 20, the electrode substrate 10, and the nozzle substrate 40, is separated by dicing (cutting) and the droplet discharging head 1 is completed.

In the fourth embodiment, since the sealing portion 26*a* for sealing the gap 12*a* formed between the diaphragm 22 and the individual electrode 12 has the TEOS layer 25*a* and the moisture permeation preventing layer 25*b* which are different in material from each other, it is possible to prevent moisture from entering the gap 12*a*. Further, since the opening of the gap 12*a* is covered by the TEOS layer 25*a* formed as the bottom layer, it is possible to thin the moisture permeation preventing layer 25*b* which requires a long film-formation time, thereby shortening the film-formation time of the sealing portion 26*a*.

Further, since the through-slot 26 used for forming the sealing portion 26*a* is disposed in the cavity substrate 20, it is possible to form the above-mentioned multilayer of the sealing portion 26*a* without damaging the individual electrodes 12.

Also, since the TEOS layer 25*a* is formed by means of a plasma CVD method, it is possible to prevent the sealing material from entering deep into the gap 12. Thus, it is possible to reduce the size of the sealing portion 26*a*, which enables two-dimensional miniaturization of the droplet discharging head 1.

FIFTH EMBODIMENT

Figure 12:
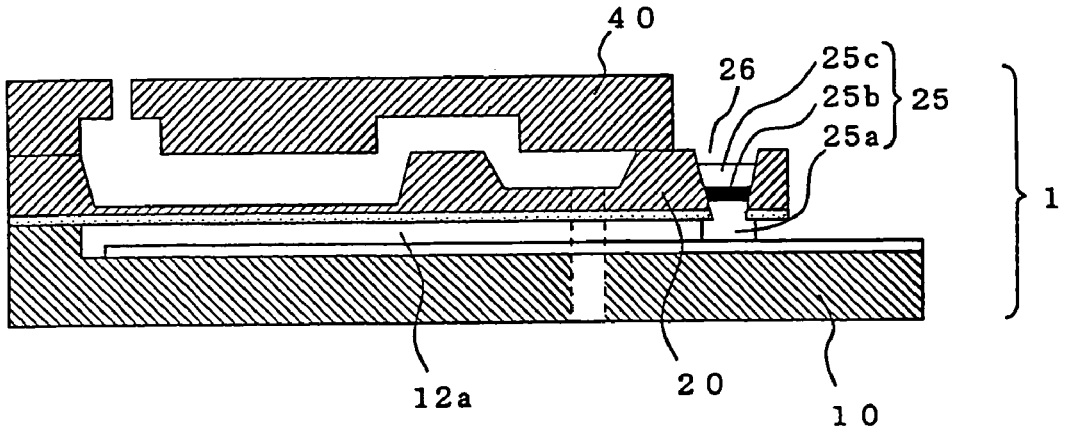
[FIG. 12]

FIG. 12 is a vertical sectional view of a droplet discharging head according to a fifth embodiment of the invention. In the droplet discharging head 1 according to the fifth embodiment, the sealing portion 26*a* comprises the TEOS layer 25*a*, the moisture permeation preventing layer 25*b* laminated on the TEOS layer 25*a*, and another TEOS layer 25*c* further laminated on the moisture permeation preventing layer 25*b*. The other constructions are the same as those of the droplet discharging head 1 according to the first embodiment, and therefore elements and parts corresponding to the first embodiment are designated by the same reference numerals.

According to the fifth embodiment, the sealing portion 26*a* comprises the TEOS layer 25*a*, the moisture permeation preventing layer 25*b* laminated on the TEOS layer 25*a*, and the another TEOS layer 25*c*, which is superior in chemical resistance, laminated on the moisture permeation preventing layer 25*b*. Therefore, it is possible to prevent moisture from entering the gap 12*a* effectively, and hence to result in formation of the sealing portion 26*a* which is superior in chemical resistance. Further, it is possible to thin the sealing portion 26*a*, as is the case of the first embodiment, and thereby to miniaturize the droplet discharging head 1.

SIXTH EMBODIMENT

Figure 13:
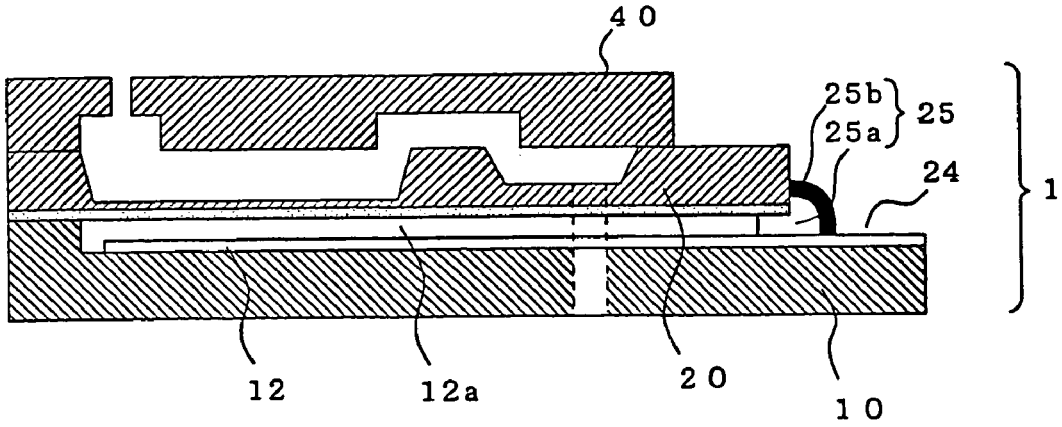
[FIG. 13]

FIG. 13 is a vertical sectional view of a droplet discharging head according to a sixth embodiment of the invention. The droplet discharging head 1 according to the third embodiment of the invention has not the through-slot 26 formed therein, but instead it has the sealing portion 26*a*, formed at the opening of the gap 12*a*, consisting of the one TEOS layer 25*a* and the one moisture permeation preventing layer 25*b*. Here, the opening of the gap 12*a* means a part of the gap 12*a* which communicate with the outside on a side of the electrode taking-out portion 21. The droplet discharging head 1 of FIG. 6 has the moisture permeation preventing layer 25*b* formed on the TEOS layer 25*a*. The other constructions are the same as those of the droplet discharging head 1 according to the first embodiment, and therefore elements and parts corresponding to the first embodiment are designated by the same reference numerals.

In order to form the sealing portion 26*a* of the sixth embodiment, it is recommendable to form the TEOS layer 25*a* and the moisture permeation preventing layer 25*b* by means of a plasma CVD method or a sputtering method, etc., while protecting the individual electrodes 12 at the electrode taking-out portion 24 by a mask made of silicon, etc. If a TEOS layer is further formed on the moisture permeation preventing layer 25*b*, it is possible to improve chemical resistance of the sealing portion 26*a*.

According to the third embodiment, the sealing portion 26*a* for sealing the gap 12*a* between the diaphragm 22 and the individual electrode 12 has the TEOS layer 25*a* and the moisture permeation preventing layer 25*b* which are different in material from each other. Therefore, it is possible to prevent moisture from entering the gap 12*a* more effectively than the conventional sealing portion.

SEVENTH EMBODIMENT

Figure 14:
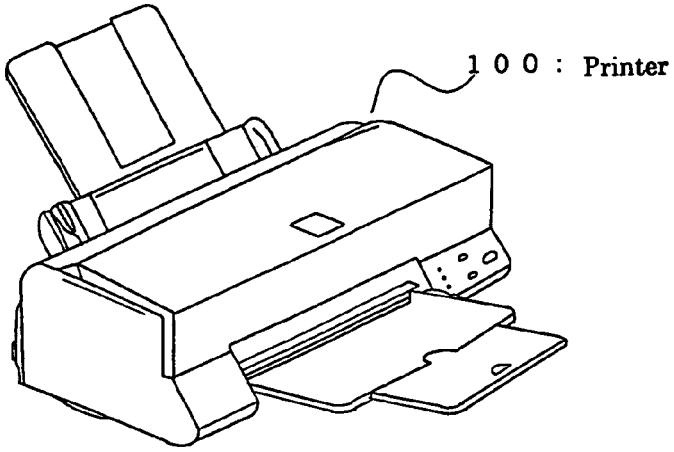
[FIG. 14]
Figure 15:
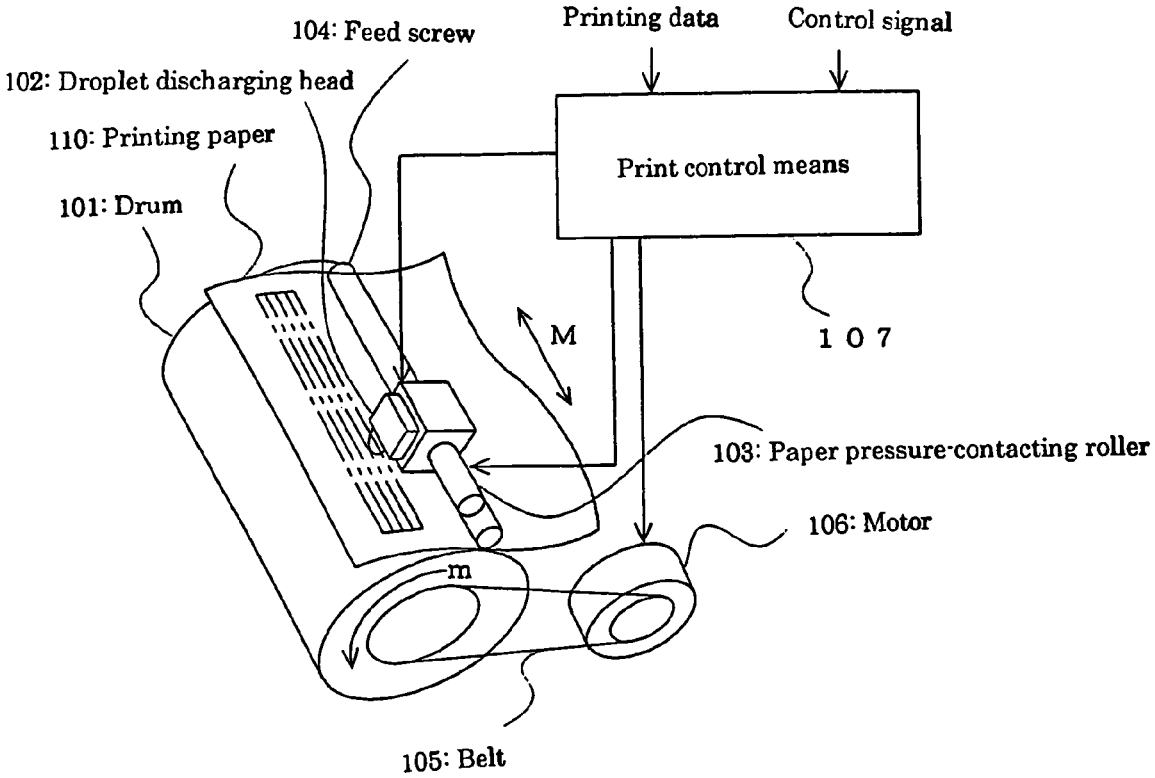
[FIG. 15]

FIG. 14 is an external view of a droplet discharging apparatus (a printer 100) provided with the droplet discharging head manufactured in the above-mentioned embodiments, and FIG. 15 is a view showing one example of main constituent parts of the droplet discharging apparatus. The droplet discharging apparatus of FIGS. 14 and 15 aims to carry out printing in a droplet discharging (ink-jet) manner, and is of a so-called serial type. In FIG. 15, the droplet discharging apparatus is mainly constituted by a drum 101 on which a printing paper 110 as a sheet to be printed is supported, and a droplet discharging head 102 for discharging ink to the printing paper 110 for recording. Further, there is provided ink supplying means for supplying ink to the droplet discharging head 102 although not shown. The printing paper 110 is brought into contact under pressure with and hence held on the drum 101, by a paper pressure-contacting roller 103 disposed in parallel with an axial direction of the drum 101. Then, a feed screw 104 is provided in parallel with the axial direction of the drum 101, for holding the droplet discharging head 102 thereon. Rotation of the feed screw 104 causes the droplet discharging head 102 to be moved in the axial direction of the drum 101.

On the other hand, the drum 101 is rotatably driven by a motor 106 through a belt 105, etc. Further, a print control means 107 causes the feed screw 104 and the motor 106 to be driven based on a printing data and a control signal, and drives an oscillation driving circuit, but not shown in this drawing, to vibrate the diaphragm 4 to thereby carry out printing onto the printing paper 110 in a controlled manner.

In this embodiment, the liquid an ink is discharged to the printing paper 110. However, the liquid discharged from the droplet discharging head is not limited to ink. For example, the liquid discharged from each of droplet discharging heads, which are disposed in the following corresponding apparatus, may include liquid containing pigments for color filter for use in discharge to a substrate as a color filter, liquid containing compounds for light emitting element for use in discharge to a substrate of a display panel (OLED, etc.) using electric field light emitting elements made of organic compounds, etc., and liquid containing conductive metals, for example, for use in wiring onto a substrate.

Further, in the case where the droplet discharging head is used as a dispenser and used in discharge to a substrate as microarrays of biological molecules, this dispenser may discharge liquid including probes of DNA (deoxyribo nucleic acids), other nucleic acid (for example, ribo nucleic acid, peptide nucleic acids, etc.), protein substances, etc. Besides, the above-mentioned droplet discharging heads can be used for discharging dye for clothes, etc.

EIGHTH EMBODIMENT

Figure 16:
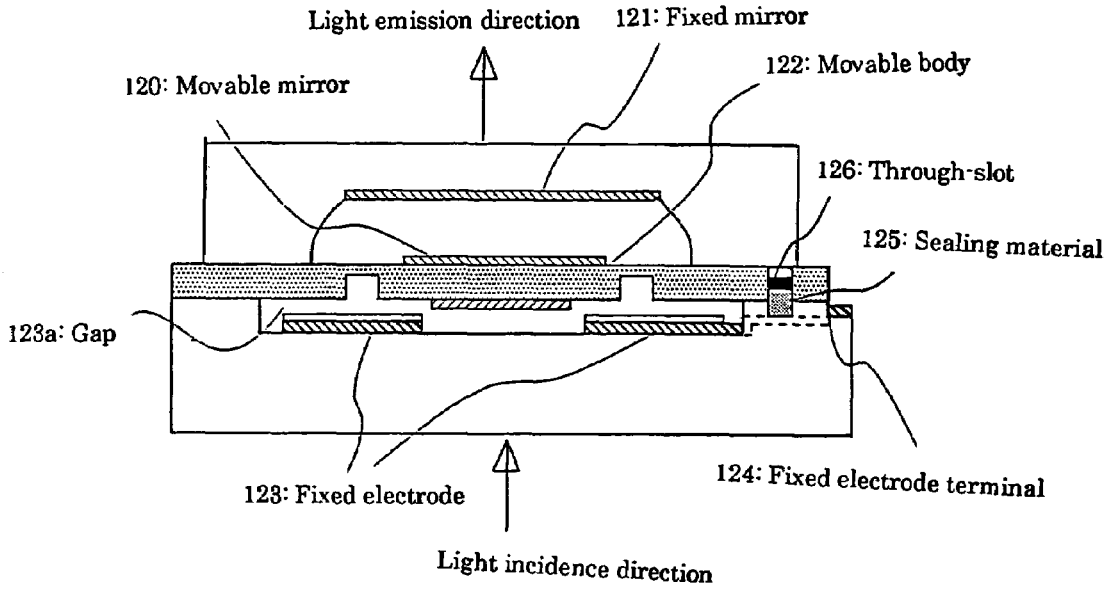
[FIG. 16]

FIG. 16 is a view of a wavelength variable optical filter using the invention. The above-mentioned embodiments will be described taking a liquid discharging head as an example, but the invention is not limited thereto, and hence the invention may be applied to electrostatic devices using a micromachining electrostatic actuator. For example, the wavelength variable optical filter of FIG. 16 utilizing the principle of a Fabry-Perot interferometer, outputs a light of a selected wavelength while changing a distance between a movable mirror 120 and a fixed mirror 121. The movable mirror 120 is moved by displacing a movable body 122 made of silicon on which the movable mirror 120 is disposed. For that purpose, the movable body 122 (movable mirror 120) is arranged so as to be opposed to a fixed electrode 123 with a predetermined distance (gap). Then, a fixed electrode terminal 124 is taken out in order to supply an electrical charge to the fixed electrode. According to the invention, there is arranged a through-slot 126, so that a sealing material 125 is capable of sealing between the substrate having the movable body and the substrate having the fixed electrode 123 reliably and gas-tightly, and further the through-slot 126 is blocked by another substrate, which provides a reliable sealing.

Similarly, the formation of the above-mentioned sealing portion, etc. can be applied to other kinds of micromachining actuators including motors, sensors, vibration elements (resonators) such as SAW filters, wavelength variable optical filters, mirror devices, etc. and sensors including pressure sensors, etc. Moreover, the invention is especially effective in electrostatic actuators, etc., but otherwise can be applied to a case in which a small opening between substrates is sealed.

EIGHTH EMBODIMENT

In the above-mentioned embodiments, since the substrate having the fixed electrode is greater in thickness than other substrates and is made of glass, the through-slot 26 is formed in the substrate having the movable electrode such as the diaphragm 22, etc., but is not limited thereto. The through-slot 26 can be formed on any substrate, whichever is easy to be formed with respect to construction, process, etc. Moreover, in the above-mentioned first embodiment, the number of the through-slot 26 is one; however, it is not limited thereto and there can be formed a plurality of the through-slots, etc. without deteriorating the sealing effect.

The invention claimed is:

1. An electrostatic actuator comprising:
a first substrate having a fixed electrode; and
a second substrate having a movable electrode which is disposed so as to be opposed to the fixed electrode with a distance, and operated due to an electrostatic force occurring between the fixed electrode and the movable electrode,
a sealing portion is formed on one of the first substrate and the second substrate, the sealing portion having a plurality of sealing layers laminated on one another, each of the sealing layers being made of a sealing material for isolating a space formed between the fixed electrode and the movable electrode from surrounding atmosphere;
at least one of the sealing layers comprises a TEOS layer including TEOS; and
at least one of the sealing layers comprises a moisture permeation preventing layer including a substance which is lower in moisture permeation property than TEOS.

2. The electrostatic actuator according to claim 1, the moisture permeation preventing layer comprises aluminum oxide, silicon nitride, silicon oxynitride, or aluminum nitride.

3. The electrostatic actuator according to claim 1, the sealing portion is formed by one TEOS layer, and one moisture permeation preventing layer laminated on the TEOS layer.

4. The electrostatic actuator according to claim 1, the sealing portion is formed by one TEOS layer, one moisture permeation preventing layer laminated on the TEOS layer, and another TEOS layer further laminated on the moisture permeation preventing layer.

5. The electrostatic actuator according to claim 1, at least one of the sealing layers is a polyparaxylene layer comprising polyparaxylene.

6. A droplet discharging head having the electrostatic actuator according to claim 1,
at least a part of a discharging chamber in which liquid is filled constitutes the movable electrode and droplets are discharged through a nozzle communicating with the discharging chamber due to displacement of the movable electrode.

7. The droplet discharging head according to claim 6, the sealing portion is covered by a substrate having a reservoir formed therein, the reservoir serving as a common liquid chamber from which liquid is supplied to a plurality of discharging chambers.

8. The droplet discharging head according to claim 6, the sealing portion is covered by a substrate having a nozzle formed therein, the nozzle communicating with the discharging chamber and discharging liquid pressurized in the discharging chamber as droplets.

9. A droplet discharging apparatus having the droplet discharging head according to claim 6 mounted thereon.

10. An electrostatic device having the electrostatic actuator according to claim 1 mounted thereon.

11. An electrostatic actuator comprising:
a first substrate having a fixed electrode; and
a second substrate having a movable electrode which is disposed so as to be opposed to the fixed electrode with a distance, and operated due to an electrostatic force occurring between the fixed electrode and the movable electrode, a through-slot through which a sealing material for isolating a space formed between the fixed electrode and the movable electrode from surrounding atmosphere is formed within a predetermined range is disposed in one of the first substrate and the second substrate, and a sealing portion is formed by encapsulating the sealing material through the through-slot, the sealing portion having a plurality of sealing layers laminated on one another;

at least one of the sealing layers comprises a TEOS layer including TEOS; and at least one of the sealing layers comprises a moisture permeation preventing layer including a substance which is lower in moisture permeation property than TEOS.

12. The electrostatic actuator according to claim 11, the second substrate has an exposed portion which does not come in contact with a third substrate to be laminated, and the through-slot is formed at the exposed portion.

13. The electrostatic actuator according to claim 11, further comprising a third substrate for blocking the sealing portion.

14. The electrostatic actuator according to claim 13, a sealing material clearance groove is provided in the third substrate on a surface which blocks the sealing portion of the third substrate, for preventing the sealing material forced out of the through-slot from contacting the third substrate, and the sealing material clearance groove has a size defined based on the sealing portion.

15. The electrostatic actuator according to claim 14, the sealing material clearance is not less than 40 μm in depth.

16. The electrostatic actuator according to any one of claims 1 to 15, at least one of the sealing layers is a layer comprising tantalum pentoxide, DLC, PDMS, or epoxy resin.

17. The electrostatic actuator according to claim 16, only the TEOS layer formed as a lower layer covers an opening of the space by a single layer.

* * * * *